US008181423B2

(12) United States Patent
Bartlett et al.

(10) Patent No.: US 8,181,423 B2
(45) Date of Patent: May 22, 2012

(54) BEAM

(75) Inventors: Ross John Bartlett, Via Beaudesert (AU); Ross Ian Dempsey, Calamvale (AU); Russell Lambert Watkins, Coorparoo (AU); Alexander Noller, Springwood (AU); Keiji Yokoyama, Chiba (JP)

(73) Assignee: Smorgon Steel Litesteel Products Pty Ltd., South Melbourne, Victoria (AU)

( * ) Notice: Subject to any disclaimer, the term of this patent is extended or adjusted under 35 U.S.C. 154(b) by 0 days.

(21) Appl. No.: 13/048,706

(22) Filed: Mar. 15, 2011

(65) Prior Publication Data

US 2011/0162320 A1 Jul. 7, 2011

Related U.S. Application Data

(63) Continuation of application No. 12/555,877, filed on Sep. 9, 2009, now abandoned, which is a continuation of application No. 10/561,185, filed as application No. PCT/AU2004/000824 on Jun. 23, 2004, now abandoned.

(30) Foreign Application Priority Data

Jun. 23, 2003 (AU) ..... 2003903142

(51) Int. Cl.
*E04H 12/00* (2006.01)
*E04C 3/00* (2006.01)

(52) U.S. Cl. ..... 52/836; 52/837; 52/838; 52/846; 52/690

(58) Field of Classification Search ..... 52/653.1, 52/634, 636, 690, 836, 837, 838, 846; 29/897.35; D25/122, 124
See application file for complete search history.

(56) References Cited

U.S. PATENT DOCUMENTS

| | | | |
|---|---|---|---|
| 426,558 | A | 4/1890 | Dithridge |
| D27,394 | S | 7/1897 | Horton |
| D28,864 | S | 6/1898 | Baker |
| 991,603 | A | 5/1911 | Brooks |
| 1,351,615 | A | 8/1920 | Brown et al. |
| 1,377,251 | A | 5/1921 | Hunker |
| 2,264,897 | A | 12/1941 | Becker et al. |
| 2,997,141 | A | 8/1961 | Wetzler |
| 3,066,772 | A | 12/1962 | Gibson |
| 3,199,174 | A | 8/1965 | Nilsson et al. |
| 3,221,467 | A | 12/1965 | Henkels |
| 3,241,285 | A | 3/1966 | Baroni |
| 3,256,670 | A | 6/1966 | Tersigni |

(Continued)

FOREIGN PATENT DOCUMENTS

| | | |
|---|---|---|
| AU | 1986-52906 | 6/1989 |

(Continued)

OTHER PUBLICATIONS

AISC Engineering article (AISC Engineering Journal), Oct. 1964, pp. 132-136.

(Continued)

*Primary Examiner* — Robert Canfield
*Assistant Examiner* — Charissa Ahmad
(74) *Attorney, Agent, or Firm* — Leydig, Voit & Mayer, Ltd.

(57) ABSTRACT

A hollow flange channel beam has a planar web with a pair of narrow rectangular cross-section flanges extending along opposite sides of said web and extending perpendicular to a face of said web in the same direction. The section capacity is optimized when Wf=(0.3)Db, Wf=(3.0)Df and WF=(30)t.

15 Claims, 20 Drawing Sheets

U.S. PATENT DOCUMENTS

| | | | | |
|---|---|---|---|---|
| 3,342,007 | A | 9/1967 | Merson | |
| 3,362,056 | A | 1/1968 | Preller et al. | |
| 3,517,474 | A | 6/1970 | Lanternier | |
| 3,698,224 | A | 10/1972 | Saytes | |
| 3,735,547 | A | 5/1973 | Moyer et al. | |
| 3,860,781 | A | 1/1975 | Aschauer et al. | |
| 4,433,565 | A | 2/1984 | Preller | |
| 4,468,946 | A | 9/1984 | Driear | |
| D291,832 | S | 9/1987 | Lundstrom | |
| 4,750,663 | A | 6/1988 | Warczak | |
| 5,012,626 | A | 5/1991 | Spelten | |
| 5,022,210 | A | 6/1991 | Scott | |
| 5,163,225 | A | 11/1992 | Goleby | |
| 5,373,679 | A | 12/1994 | Goleby | |
| 5,403,986 | A | 4/1995 | Goleby | |
| 5,501,053 | A | 3/1996 | Goleby | |
| 5,535,569 | A | 7/1996 | Seccombe et al. | |
| 5,553,437 | A | 9/1996 | Navon | |
| 5,692,353 | A | 12/1997 | Bass et al. | |
| 5,775,051 | A | 7/1998 | Nicolai et al. | |
| D417,290 | S | 11/1999 | Goleby et al. | |
| D426,320 | S | 6/2000 | Andres | |
| 6,115,986 | A | 9/2000 | Kelly | |
| 6,131,362 | A | 10/2000 | Buecker | |
| 6,363,682 | B1 | 4/2002 | Cowley | |
| 6,397,550 | B1 | 6/2002 | Walker et al. | |
| 6,415,577 | B1 | 7/2002 | Curtis | |
| 6,436,552 | B1 | 8/2002 | Walker et al. | |
| 6,591,576 | B1 | 7/2003 | Iida et al. | |
| 6,637,172 | B2 | 10/2003 | Bousquet | |
| 6,688,070 | B2 | 2/2004 | Vahey | |
| 6,796,101 | B2 * | 9/2004 | Chen | 52/781 |
| 6,826,884 | B2 | 12/2004 | Pabedinskas et al. | |
| 6,874,294 | B2 * | 4/2005 | Masterson et al. | 52/696 |
| 6,874,765 | B2 * | 4/2005 | Deeley | 256/21 |
| D541,437 | S | 4/2007 | Dempsey et al. | |
| D541,438 | S | 4/2007 | Dempsey et al. | |
| D542,421 | S | 5/2007 | Dempsey et al. | |

FOREIGN PATENT DOCUMENTS

| | | | | |
|---|---|---|---|---|
| AU | 716272 | B2 | | 2/2000 |
| AU | 724555 | B2 | | 9/2000 |
| DE | 24 59 421 | A1 | | 6/1976 |
| EP | 267843 | A1 | * | 5/1988 |
| EP | 540325 | A1 | * | 5/1993 |
| EP | 0 550 578 | B1 | | 7/1993 |
| GB | 2 093 886 | A | | 9/1982 |
| GB | 2 102 465 | A | | 2/1983 |
| GB | 2 261 248 | A | | 5/1993 |
| GB | 2 366 084 | A | | 2/2002 |
| GB | 2366084 | | * | 2/2002 |
| KR | 20010077017 | A | | 8/2001 |
| SE | 444464 | B | | 4/1986 |
| SU | 827723 | | | 5/1981 |
| SU | 1558529 | A1 | | 4/1990 |
| WO | WO 91/17328 | A1 | | 11/1991 |
| WO | WO 94/023149 | A1 | | 10/1994 |
| WO | WO 96/23939 | A1 | | 8/1996 |

OTHER PUBLICATIONS

Australian Patent Office International Search Report in International Application No. PCT/AU2004/000824 (Jul. 22, 2004).

Keerthan, *New design rules for the shear strength of LiteSteel beams*, Journal of Constructional Steel Research 67, pp. 1050-1063 (2011).

* cited by examiner

BEAM

This application is a continuation of U.S. patent application Ser. No. 12/555,877, filed Sept. 9, 2009, now abandoned which was a continuation of U.S. patent applicattion Ser. No. 10/561,185, filed Mar. 1, 2007, now abandoned which was a National Stage application, under 35 U.S.C. §371, of international application PCT/AU2004/00824, filed Jun. 23, 2004, which claims priority to Australian Provisional Patent Application No. 2003903142, filed Jun. 23, 2003. All of the applications cited above are incorporated by reference herein, as if set forth in their entireties.

FIELD OF THE INVENTION

This invention is concerned with improvements in structural beams.

The invention is concerned particularly, although not exclusively, with a hollow flanged channel wherein opposed hollow flanges along opposite sides of a web extend away from the web in the same direction.

BACKGROUND OF THE INVENTION

Throughout history there has been an on-going quest by engineers to develop cheaper and/or stronger structural members such as beams or girders for all manner of structures including buildings, bridges, ship structures, truck bodies and chassis, aircraft and the like.

For several millennia timber was the primary source of material for structural beams in buildings and bridges and the last several centuries in particular have seen dramatic advancements from timber to cast iron to wrought iron to mild steels and thence to sophisticated steel alloys. Along with the advancement in structural beam materials has gone improvements in fabrication techniques and this, in turn, has permitted significant advances in structural engineering. Throughout this period of change and development in structural engineering, history has witnessed the emergence of unique driving forces which have had a profound influence on the nature and direction of these changes and developments. These drivers have included labour costs, material costs and, of more recent times, environmental issues.

U.S. Design Pat. Nos. 27394 and 28864 illustrate early forms of an I-beam and C-channel respectively while U.S. Pat. No. 426,558 illustrates early forms of hollow flanged beams, possibly made by a casting process.

Improvements in fabrication methods then led to structural members of reduced mass whilst retaining structural performance. U.S. Pat. No. 1,377,251 is indicative of a cold roll forming process of a hollow flanged trough channel, while U.S. Pat. No. 3,199,174 describes a method of fabrication and reinforcement of I-shaped beams by welding together separate strips of metal. U.S. Pat. No. 4,468,946 describes a method for fabrication of a beam having a lambda-shaped cross-section by bending a sheet of metal, and U.S. Pat. No. 4,433,565 describes the manufacture by cold or hot shaping of metal members having a variety of cross-sectional shapes. U.S. Pat. No. 3,860,781 and Russian Inventor's Certificate 245935 both describe the automated fabrication of I-beams from separate web and flange strips fused together. U.S. Pat. No. 5,022,210 describes a milled timber beam having a solid central web portion narrower than solid flanges extending along opposite sides of the web.

Composite beam or truss structures fabricated from a plurality of components are known to provide good strength to weight ratios as illustrated in U.S. Pat. No. 5,012,626 which describes an I-beam-like structure having planar flanges connected to a transversely corrugated web. Other transversely corrugated web beams are disclosed in U.S. Pat. Nos. 3,362,056 and 6,415,577, both of which contemplate hollow flange members of rectangular cross-section. Other transversely corrugated web beams with hollow rectangular cross-section flanges are described in Australian Patent 716272 and Australian Patent Application AU 1986-52906. A method of fabrication of hollow flanged beams with corrugated webs is disclosed in U.S. Pat. No. 4,750,663.

While the prior art is replete with structural members and beams of widely varying configurations, a majority of such structural members or beams have been designed with a specific end use in mind although some are designed as general purpose beams to replace say, a conventional hot rolled I-beam. U.S. Pat. No. 3,241,285 describes a hollow fabricated beam of thin austenitic stainless steel which offers high strength to weight ratios and lower maintenance costs than hot rolled I-beams in bridge building applications. Another type of fabricated bridge girder known as the "Delta" girder is described in AISC Engineering Journal, October 1964, pages 132-136. In this design, one or both of the flange plates is stiffened by bracing plates extending the full length of the beam on both sides between the flange plate(s) and the web.

U.S. Pat. No. 5,692,353 describes a composite beam comprising cold rolled triangular hollow section flanges separated by spaced wooden blocks for use as prefabricated roof and floor trusses. United Kingdom Patent Application GB 2 093 886 describes a cold rolled roofing purlin having a generally J-shaped cross-section, while United Kingdom Patent Application GB 2 102 465 describes an I- or H-section beam rolled from a single strip of metal. International Publication WO 96/23939 describes a C-section purlin for use in a roof supporting building, and U.S. Pat. No. 3,256,670 describes a sheet metal joist having a double thickness web with hollow flanges, the web and the flanges being perforated to allow the joist to be incorporated into a cast concrete floor structure.

U.S. Pat. No. 6,436,552 describes a cold roll formed thin sheet metal structural member having hollow flanges separated by a web member. This member is intended to function as a chord member in a roof truss or floor joist.

The aforementioned examples of structural members or beams represent only a small fraction of the on-going endeavours to provide improvements in beams for a plethora of applications. The present invention however, is specifically concerned with hollow flanged beams of which an early example is described in U.S. Pat. No. 426,558 mentioned earlier herein. The use of hollow flanges to increase the flange section without adding mass is well known in the art. Another early example of hollow flanged beams is described in U.S. Pat. No. 991,603 in which the free edges of triangular cross-section flanges are returned to the web without welding to the web. Similar unwelded hollow flanged beams are described in U.S. Pat. No. 3,342,007 and International Publication WO 91/17328.

Hollow flanged I-beam-like structures, with fillet welded connections between the flanges and the web are described in U.S. Pat. No. 3,517,474 and Russian Inventor's Certificate 827723. An extruded aluminium beam shown in Swedish Publication Number 444464 is formed with a ribbed planar web with hollow rectangular flanges protruding from one web face, the hollow flanges being formed by U-shaped extrusions which clip into spaced receiving ribs formed on one face of the web.

U.S. Pat. No. 3,698,224 discloses the formation of H- and I-beams and a channel section with hollow flanges by deforming welded seam steel tubing to form a double thickness web between spaced hollow flanges.

U.S. Pat. Nos. 6,115,986 and 6,397,550 and Korean Patent Application KR 2001077017 A, describe cold roll formed thin steel structural members having hollow flanges with a lip extending from each flange being secured against the face of the web by spot welds, rivets or clinches. The beams described in U.S. Pat. Nos. 6,115,986 and 6,397,550 are employed as wall studs which enable cladding to be secured to the hollow flanges by screws or nails.

British Patent No GB 2 261 248 describes hollow flanged torsion resistant ladder stiles formed by extrusion or cold roll forming.

U.S. Pat. No. 6,591,576 discloses a hollow flanged channel shaped structural member with a cross-sectionally curved web shaped by press forming to produce a longitudinally arcuate bumper bar reinforcing member for a motor vehicle.

While most of the hollow flanged structural members described above were fabricated with a closed flange with an unfixed free edge or otherwise disclosed a fixed free edge by welding or the like in a separate process, U.S. Pat. No. 5,163,225 described for the first time a cold rolling process wherein free edges of hollow flanges were fixed to the edges of the web in an in-line dual welding process. This beam was known as the "Dogbone" (Registered Trade Mark) beam and possessed hollow flanges of generally triangular cross-section. U.S. Pat. No. 5,373,679 describes a dual welded hollow flange "Dogbone" beam made by the process of U.S. Pat. No. 5,163,225. Such was the performance for price offered by these beams that a low mass thinner sectioned hot rolled universal beam was introduced into the market to counter the perceived threat to conventional universal beams of I- or H-cross-section.

Further developments of the dual weld "Dogbone" process described in U.S. Pat. No. 5,163,225 were disclosed in U.S. Pat. No. 5,403,986 which dealt with the manufacture of hollow flange beams wherein the flange(s) and the web(s) were formed from separate strips of metal as distinct from a single strip of metal in U.S. Pat. No. 5,163,225. A further development of the multiple strip process for forming hollow flange beams was described in U.S. Pat. No. 5,501,053 which taught a hollow flange beam with a slotted aperture extending longitudinally of at least one flange to permit telescopic engagement of a flange of one hollow flange beam within a hollow flange of an adjacent beam for use in structural applications as piling, walling, structural barriers or the like.

A still further development of the dual welding "Dogbone" process is described in Australian Patent 724555 and U.S. Design Pat. No. Des 417290. A hollow flange beam is formed as a channel section to act as upper and lower chords of a truss beam with a fabricated web structure secured in the channelled recess in the chord members.

While generally superior to other hollow flange beams of similar mass, the hollow flange "Dogbone" beams suffered a number of limitations both in manufacture and in performance. In a manufacturing sense, the range of sizes of "Dogbone" beams available from a conventional tube mill was limited at a lower end by the proximity of inner mill rolls and otherwise limited at a larger end by the size of the roll stands. While "Dogbone" beams generally exhibited increased capacity per unit mass or per unit cost when compared to conventional "open" (unwelded) hollow flange beams or conventional angle sections, I-beams, H-beams and channels, they also exhibited a surprisingly high torsional rigidity and thus a resistance to flexural (lateral) torsional buckling over longer lengths. These hollow flange beams failed due to a unique lateral distortional buckling mode of failure not found in other similar products. Similarly, while the sloping inner flange faces provided an excellent deterrent for avian and rodent pests in some structural applications, the capacity for the flange to resist local bearing failure was less than other beams such as I-beams due to flange crushing. Additionally, special attachment fittings were required because of the cross-sectional shape.

Conventionally, the selection of a structural beam for use in a structure was usually made by an engineer after reference to standard engineering tables to ascertain section efficiencies and load bearing capacity in a range of readily available "standard" beams such as laminated timber, hot rolled H-, L- or I-beams and channels, cold rolled beams such as C-, Z-, J-shaped purlins or the like. The higher the value of bending capacity per unit mass, the more efficient the section. This value measures the performance per unit cost thus allowing a comparison of cost efficiencies of various beams by taking into account the cost per unit mass for each product.

Where special performance requirements are demanded of a beam, cost or cost efficiency may be governed by other factors and often this is the impetus to design a special purpose beam for a specific application. Otherwise, as the prior art so clearly demonstrates, there has been and there continues to be an on-going quest to produce more cost effective general purpose beams having greater section efficiencies than widely used conventional general purpose timber laminate beams, hot rolled I-, L- and H-beams, hot rolled channels and cold rolled purlin beams of various cross-sectional shapes. The fact that few, if any of the plethora of prior art "improvements" has been adopted for widespread use is probably due to an inability to combine both general cost efficiency with general section efficiency.

The assignee of the present invention, is successor in title to the "Dogbone" dual weld hollow flange beam inventions and has conducted an exhaustive survey into actual costs of incorporating a "Dogbone"-type beam into a structure with a view to designing a hollow flange dual welded cold rolled general purpose beam which, between manufacture, handling and transportation and ultimate incorporation in a structure, was more cost effective in a holistic sense than any of the prior art conventional general purpose beams which otherwise overcame several recognized disadvantages in the "Dogbone" beam, namely, connectivity and a capacity for flange crushing with localized loads.

A conjoint research methodology was developed to measure the individual product attribute utility for various beam profiles with builders, engineers and architects. These key attributes were then assigned values to produce a utility rating from which a customer value analysis for various types of beams could enable a direct comparison based on many product attributes other than merely cost/unit mass and section efficiency. From this customer value utility analysis, a range of dual welded hollow flange beam configurations in both mild steel and thin gauge high strength steel were devised as potential replacements for hot rolled steel beams such as I- and H-beams and hot rolled channel as well as laminated timber beams.

Among the many attributes considered in relation to hot rolled steel beams, connectivity and cost of handling with cranes were significant issues. U.S. Pat. No. 6,637,172, which describes a clip to enable attachment to the flanges of hot rolled structural beams, is indicative of the connectivity problems of such beams. As far as timber was concerned, dwindling availability, length availability, termites, straightness, and weather deterioration were significant factors which adversely affected customer value analyses.

Accordingly, it is an aim of the present invention to overcome or alleviate at least some of the disadvantages of prior art general purpose structural beams and to provide a structural beam of greater overall customer utility than such prior art general purpose structure beams.

SUMMARY OF THE INVENTION

According to one aspect of the invention there is provided a channel-shaped structural beam comprising:— a planar elongate web; and, hollow parallel sided flanges extending parallel to each other perpendicularly from a plane of said web along opposite sides thereof, said hollow flanges both extending in the same direction away from said plane of said web, said beam characterized in that a ratio of the width of each said flange between opposite end faces thereof in a direction perpendicular to said plane of said web and the depth of said beam between opposite outer faces of said flanges is in the ratio of from 0.2 to 0.4.

Preferably, the ratio of the width of each said flange to the depth of each said flange is in the range of from 1.5 to 4.00.

Suitably, the ratio of the width of the flange to the thickness of the web is in the range of from 15 to 50.

If required, the ratio of said width of each said flange and the depth of said flange is in the range of from 2.5 to 3.5.

Preferably, the ratio of said width of each said flange and said depth of each said flange is in the range of from 2.8 to 3.2.

The ratio of the width of each said flange to the depth of said beam may be in the ratio of from 0.25 to 0.35.

Preferably, the ratio of the width of each said flange to the depth of said beam is in the range of from 0.28 to 0.32.

If required, the ratio of the width of the flange to the thickness of the web may be in the range of from 25 to 35.

Preferably the ratio of the width of the flange to the thickness of the web is in the range of from 28 to 32.

Suitably, said beam is fabricated from steel.

Preferably, said beam is fabricated from high strength steel greater than 300 MPa.

If required, said beam may be fabricated from stainless steel.

The beam may be fabricated from a planar web member with a hollow tubular member continuously welded along opposite sides of said web member to form hollow flanges, each said hollow flange having an end face lying substantially in the same plane as an outer face of said web member.

Preferably, said beam is fabricated from a single sheet of steel.

If required, said beam may be fabricated by a folding process.

Alternatively, said beam may be fabricated by a roll forming process.

Suitably, free edges of hollow flanges are continuously seam welded to an adjacent web portion to form closed hollow flanges.

Said free edges of said hollow flanges may be continuously seam welded to said one face of said web intermediate opposite edges of said web.

Alternatively, said free edges of said hollow flanges may be continuously seam welded along respective side boundaries of said web.

Most preferably, said structural beam is fabricated in a continuous cold rolling process.

Suitably, said free edges of said hollow flanges are continuously seam welded by a non-consumable electrode welding process.

Alternatively, said free edges of said hollow flanges are continuously seam welded by a consumable electrode process.

Preferably, said free edges of said hollow flanges are continuously seam welded by a high frequency electrical resistance welding or induction welding process.

If required, said structural beams may be fabricated from sheet steel having a corrosion resistant coating.

Alternatively, said structural beams may be coated with a corrosion resistant coating subsequent to welding of said free edges of said flanges.

If required, said flange may include one or more stiffening ribs.

Suitably, said web may include stiffening ribs.

The stiffening ribs may extend longitudinally of said web.

Alternatively, the stiffening ribs may extend transversely of said web.

BRIEF DESCRIPTION OF THE DRAWINGS

In order that the present invention may be more fully understood and put into practical effect, reference will now be made to preferred embodiments of the invention illustrated in the accompanying drawings in which:—

Throughout the drawings, where appropriate, like reference numerals are employed for like features for the sake of clarity.

DETAILED DESCRIPTION OF THE DRAWINGS

Figure 1:
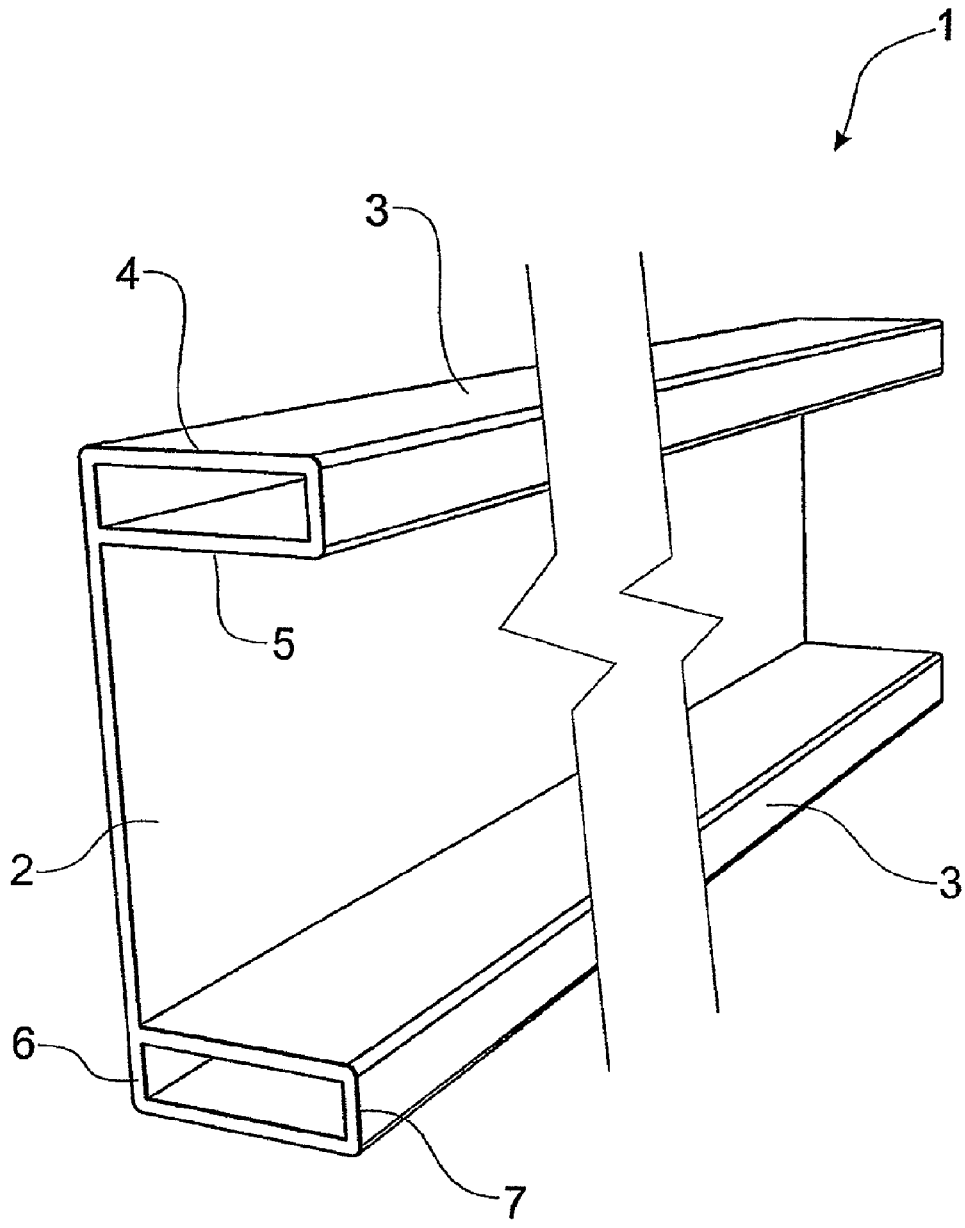
FIG. 1 shows a typical configuration of a structural beam according to the invention.

In FIG. 1, the beam 1 comprises a central web 2 extending between hollow flanges 3 having a rectangular cross-section.

The opposite sides 4,5 of each flange 3 are parallel to each other and extend away from web 2 in the same direction perpendicular to the plane of web 2. End faces 6,7 of flanges 3 are parallel to each other and end face 6 lies in the same plane as web 2.

Figure 2:
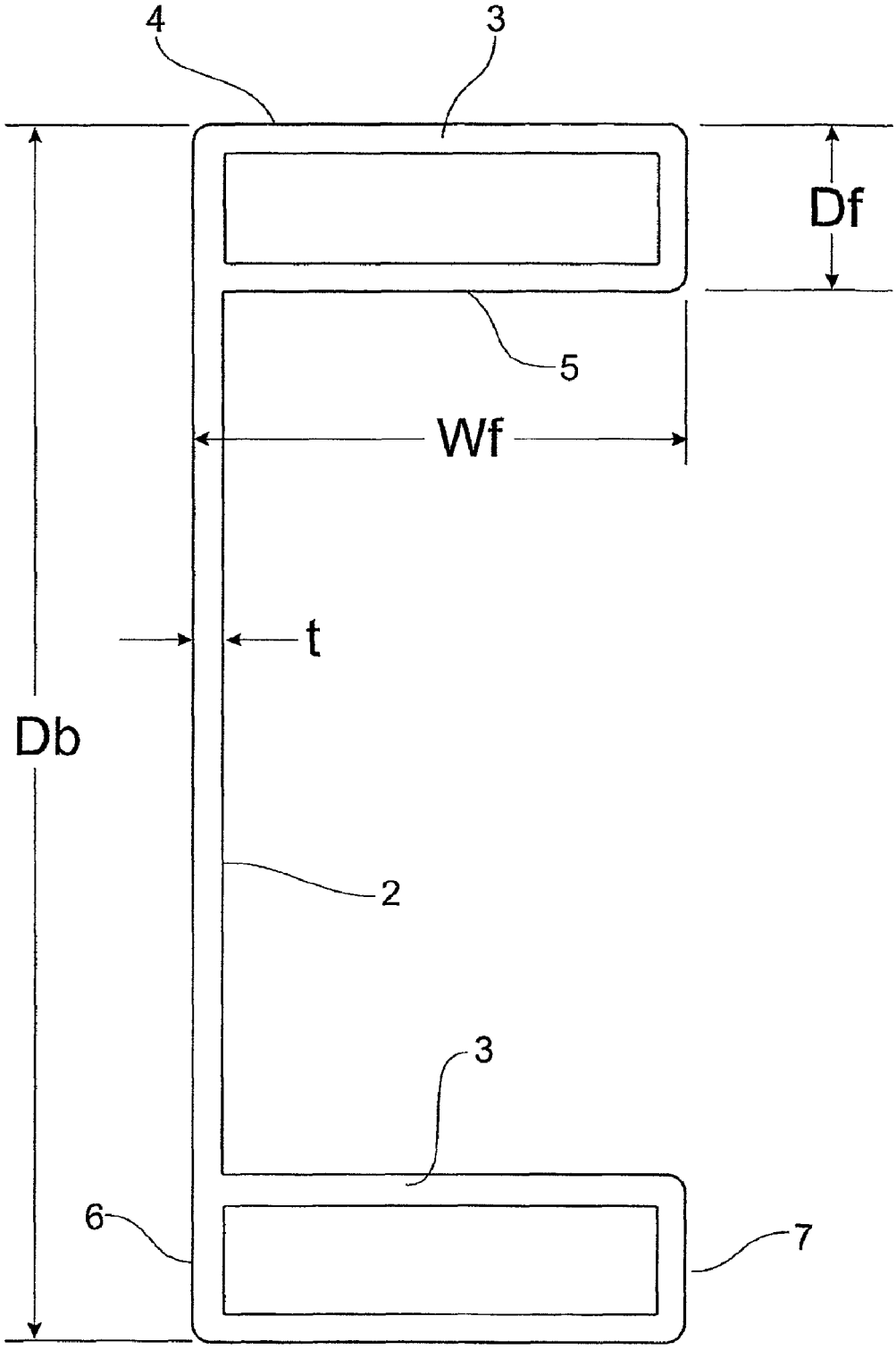
FIG. 2 shows schematically a cross-sectional view of the hollow flange beam of FIG. 1.

FIG. 2 shows a cross-sectional view of the beam of FIG. 1 to demonstrate the relationship between the width Wf of the flanges 3, the depth Df of the flanges, the depth Db of the beam and the thickness t of the steel from which the beam is fabricated.

In devising the shape of the hollow flange channel according to the invention, advantage was taken of the capacity to employ higher strength (350-500 MPa) steel than the 250-300 MPa grade typically employed in current hot rolled beams. From the outset this permitted the use of lighter gauge steels to create low mass beams. A difficulty then confronted was the greater tendency of light gauge cold rolled beams to undergo a variety of buckling failure modes and this range of buckling failure modes in turn gave rise to a selection of conflicting solutions in that while one structural proposal reduced one failure mode it frequently introduced another failure mode. For example, by shifting the mass of the flanges away from the neutral axis of the beam differing buckling modes of failure were introduced. With these conflicts in mind, a hollow flange channel section as shown in FIGS. 1 and 2 was devised as a chosen compromise and it has been determined that optimum section efficiencies are obtained when Wf=(0.3)Db, Wf=(3)Df, and, Wf=(30)t.

Although optimum sectional efficiencies are desirable, it is recognized that there will be instances where some variation will be required as a result of rolling mill constraints, end user specific dimensional requirements and the like. In this context, quite good section efficiencies can be retained with flange width ratios in the ranges Wf=(0.15-0.4)Db, Wf=(1.5-4.0)Df, and, Wf=(15-50)t.

Figure 3:
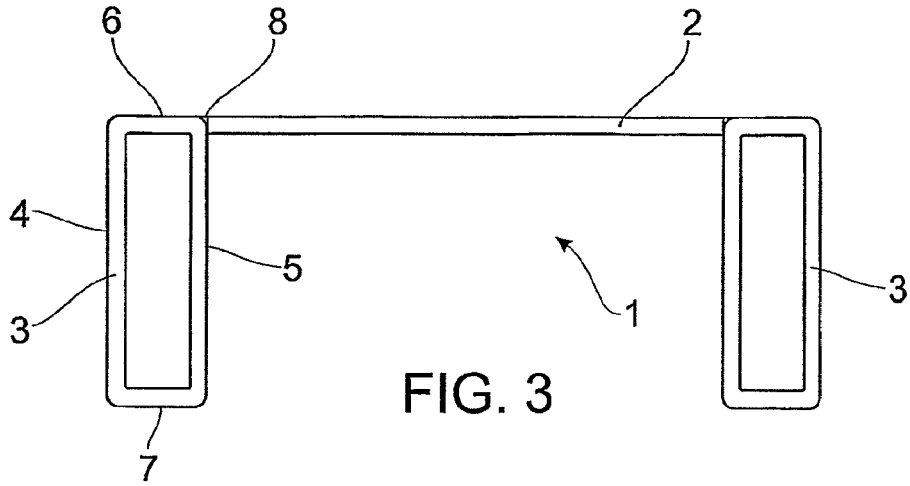
FIG. 3 shows schematically an alternative embodiment of a fabricated beam.

FIG. 3 shows schematically a structural beam according to the invention wherein the beam 1 is fabricated from separate web and flange elements 2,3 respectively. Web 2 is continuously seam welded along its opposite edges to radiussed corners 3*a* at the junction between sides 5 and end faces 6.

Weld seam 8 may be formed in a continuous operation by high frequency electrical resistance or induction welding. Alternatively, in a semi-continuous operation, the weld seam 8 may be formed utilizing a consumable welding electrode in a MIG, TIG, SMAW, SAW GMAW, FCAW welding process laser or plasma welding or the like. Where a semi-continuous consumable welding electrode process is utilized, it is considered that a post welding rolling or straightening process may be required to remove thermally induced deformations. The continuous weld seam 8 is a full penetration weld which creates an integrally formed planar web member 2 extending between outer sides 4 of flanges 3.

Whilst semi-continuous fabrication is quite inefficient compared with a continuous cold rolling process, it may be cost efficient for a short run of a specially dimensioned non-standard beam. In addition, fabrication of a beam from separate preformed web and flange elements permits the use of elements of differing thickness and/or strength. For example, such a beam may comprise flanges of a thick high strength steel and a web of thinner lower grade steel.

Figure 4:
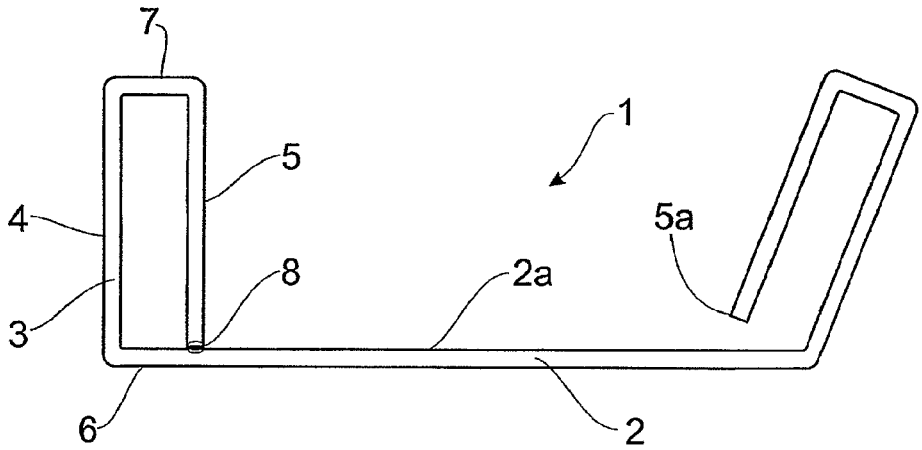
FIG. 4 shows a further embodiment of a fabricated beam.

FIG. 4 shows an alternative process for fabrication of discrete beam lengths by shaping the hollow flanged beam from a single strip of metal by folding in a press brake or the like (not shown).

Typically, a closed flange may be formed by progressively folding side 5 relative to end face 7, then folding end face 7 relative to side 4 and then finally folding side 4 relative to web 2 until a free edge 5*a* contacts an inner surface 2*a* of the channel-like beam so formed. A full penetration weld seam 8 is then formed between free edge 5*a* and web 2 to form a unitary structure, again with a continuous planar web member 2 extending between outer sides 4 of flanges 3.

Figure 5:
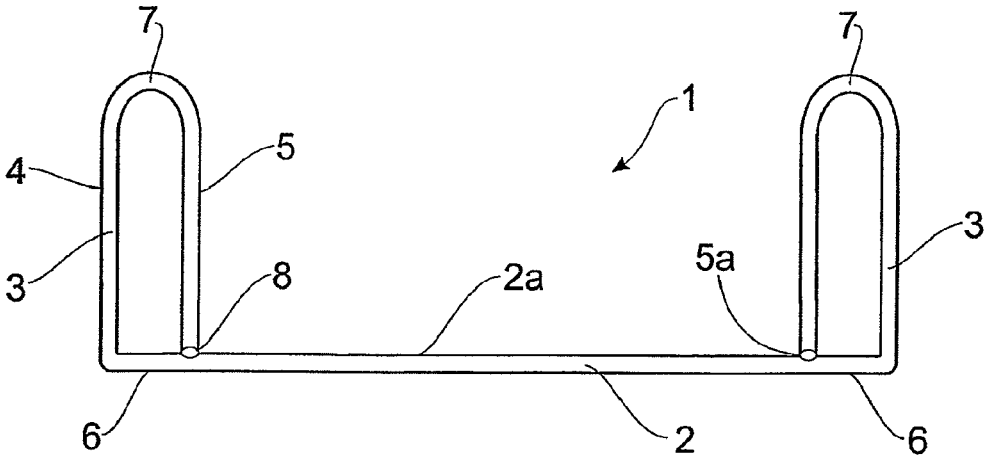
FIG. 5 shows one configuration of a cold roll formed beam according to the invention.

FIG. 5 shows one configuration of a beam according to the invention when made by a continuous cold rolling process, which process is preferred because of its high cost efficiency and the ability to maintain small dimensional tolerances to produce beams of consistent quality.

In this embodiment, the end faces 7 of hollow flanges 3 are formed as radiussed curves. The section efficiency of this configuration is inferior to a rectangular cross-section flange although there may be applications for this cross-sectional configuration.

Alternatively, it may be shaped further to form a flat end face with radiussed curves.

A full penetration weld seam 8 is formed between the free edges 5*a* of sides 5 and an inner surface 2*a* of web 2 by a high frequency electrical resistance or induction welding process as described generally in U.S. Pat. No. 5,163,225. The resultant beam is an integrally formed member which relies upon the ability to transmit load between outer flange sides 4 via a continuous web element 2 extending therebetween.

Figure 6:
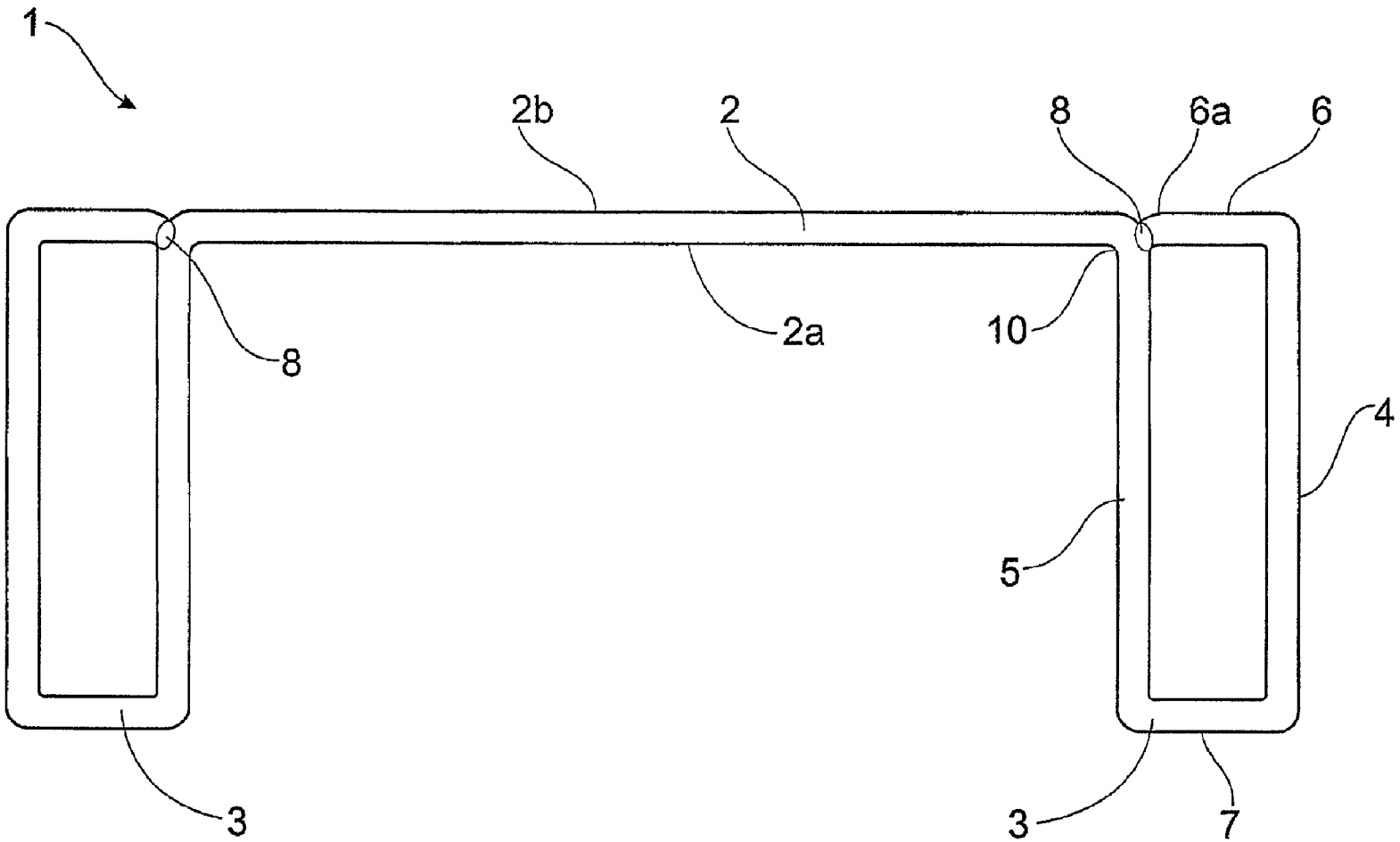
FIG. 6 shows an alternative configuration of a roll formed beam according to the invention.

FIG. 6 illustrates an alternative technique for forming a cold rolled beam according to the invention.

In this embodiment a free edge 6*a* of end face 6 of hollow flange 3 is welded to the radiussed junction 10 between web 2 and side 5 by high frequency electrical resistance or induction welding to form a full penetration weld seam 8 which effectively creates a substantially continuous planar outer surface 2*b* of a load bearing element comprising end faces 6 and web 2 whereby the load bearing element extends between outer flange sides 4.

Figure 7:
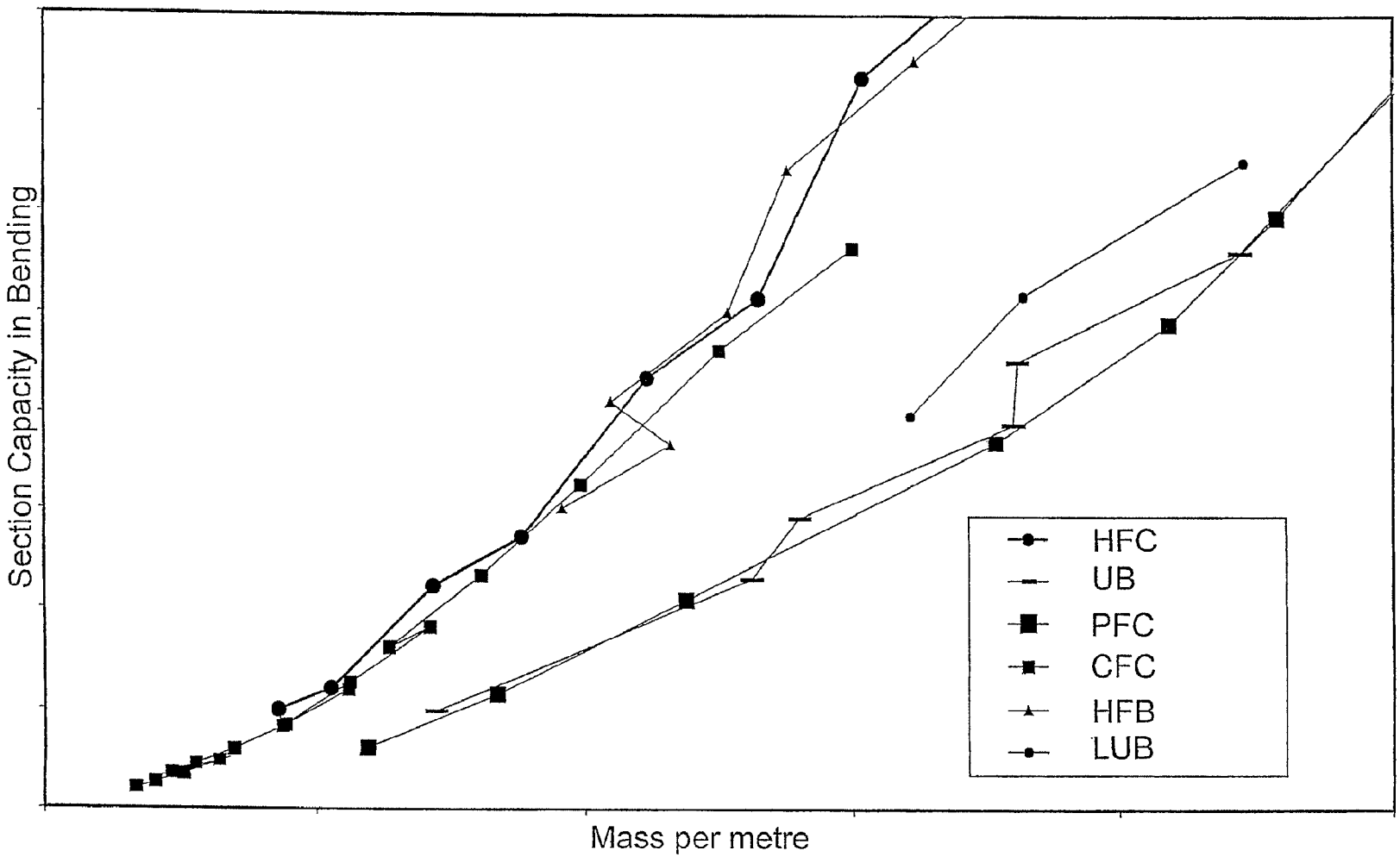
FIG. 7 shows graphically a comparison of section capacity for HFC (Hollow flange channels) according to the invention; UB (Hot rolled Universal beam of I-section), LUB (Low mass hot rolled Universal beams of I-cross-section); PFC (Hot rolled channels), CFC (Cold rolled C-sections), and HFB (Hollow flange beams of "Dogbone" configuration i.e., triangular section flanges) where the effective beam length=0.
Figure 8:
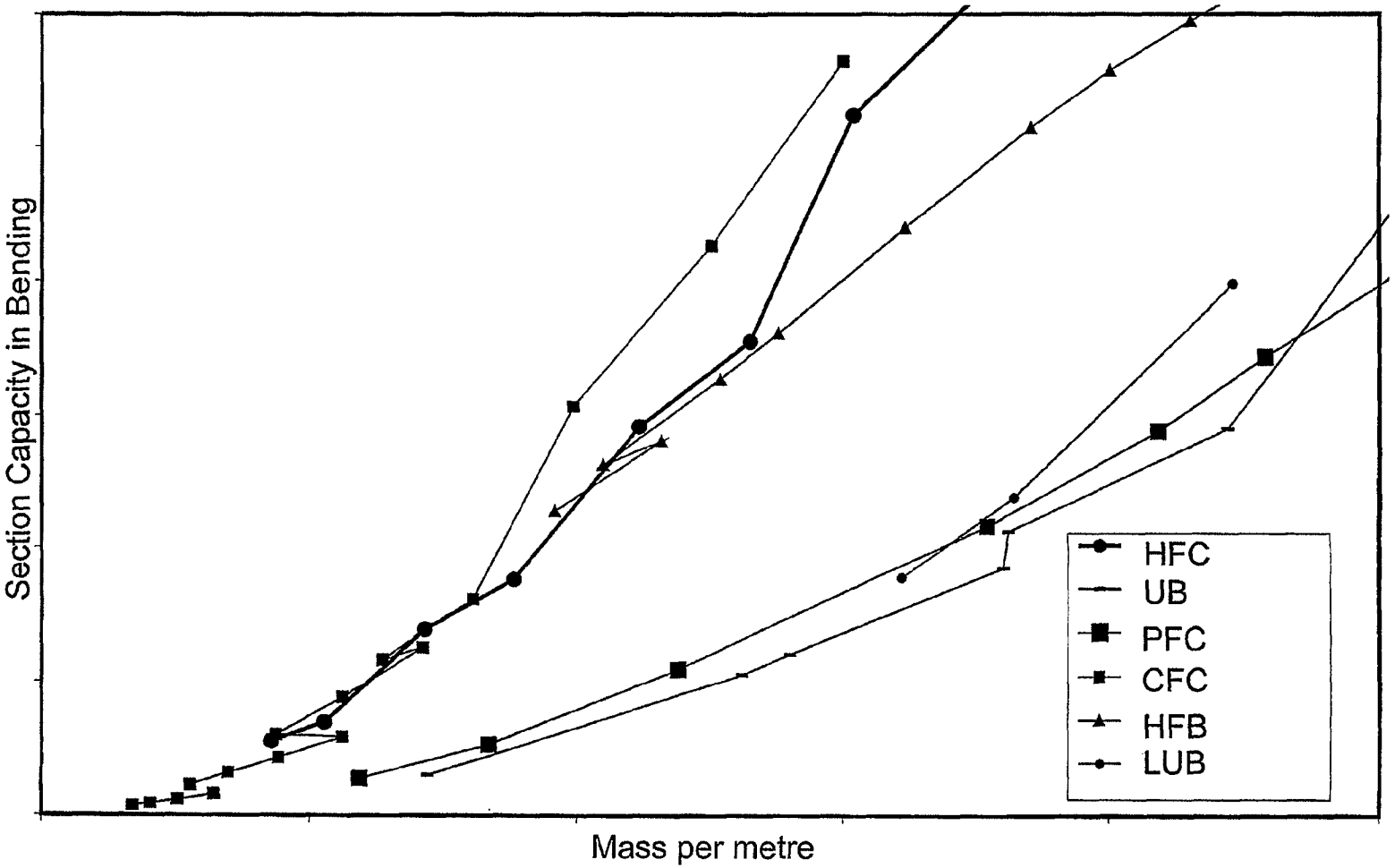
FIG. 8 shows graphically the moment capacity of the same sections where length=6.0 meterss.

FIGS. 7 and 8 show respectively section capacity and moment capacity in bending where L=6.0 meterss. The lack of smoothness in the curves for all but hot rolled channel sections arises from the selection of a variety of web depths and flange widths which manifests with overlapping values for each section on an increasing mass based axis.

Based on a simple capacity vs. mass basis, it readily can be seen that hot rolled universal beams (UB), low mass universal beams (LUB) and hot rolled channels (PFC) are quite inferior to cold rolled C-shaped purlin sections (CFC) and hollow flanged (HFB) beams such as the "Dogbone" beam with triangular-shaped flanges and the hollow flange channels (HFC) according to the present invention.

The size ranges selected for the comparison are shown in Table 1.

TABLE 1

| Section | Web (min) | Web (max) |
|---|---|---|
| HFC | 125 mm | 300 mm |
| UB/LUB | 100 mm | 200 mm |
| PFC | 75 mm | 250 mm |
| CFC | 100 mm | 350 mm |
| HFB | 200 mm | 450 mm |

The graphs clearly illustrate the superior section capacity of the HFC hollow flange channel over all other comparable beams and exhibits superior moment capacity over longer lengths.

When the conjoint analysis ratings are then applied to the sections evaluated, the attributes of the hollow flange channel over the compared standard sections generate a utility rating which is surprisingly superior to the UB and LUB hot rolled I-beams and the HFB triangular hollow flange "Dogbone" beams.

For example, in the comparison of attribute values in Table 2 for UB hot rolled I-beams and HFC cold rolled channels according to the invention, the aggregated utility scores for the HFC beam were about 2.5 times that of the UB hot rolled I-beam at a 60% price premium over the UB hot rolled beam.

TABLE 2

| ATTRIBUTE CLASS | ATTRIBUTE |
|---|---|
| Options | Price |
| | Pre-Coatings |
| Finishing | Weld Appearance |
| | Beam Flange |
| | Length Availability |
| Inherent | Services through beam |
| | Connectivity to fixtures and fittings |
| | Connectivity to steel |
| | Connectivity to timber |
| | Resources to handle. |

Table 3 represents a utility value comparison with laminated timber beams wherein the aggregate utility value of HFC hollow flange channels according to the invention were about 2.5 times that of the laminated timber beams.

TABLE 3

| ATTRIBUTE CLASS | ATTRIBUTE |
|---|---|
| Options | Price |
| Finishing | Length Availability |
| | Beam Profile |
| Inherent | Termites |
| | Member straightness |
| | Weather Deterioration |

Figure 9:
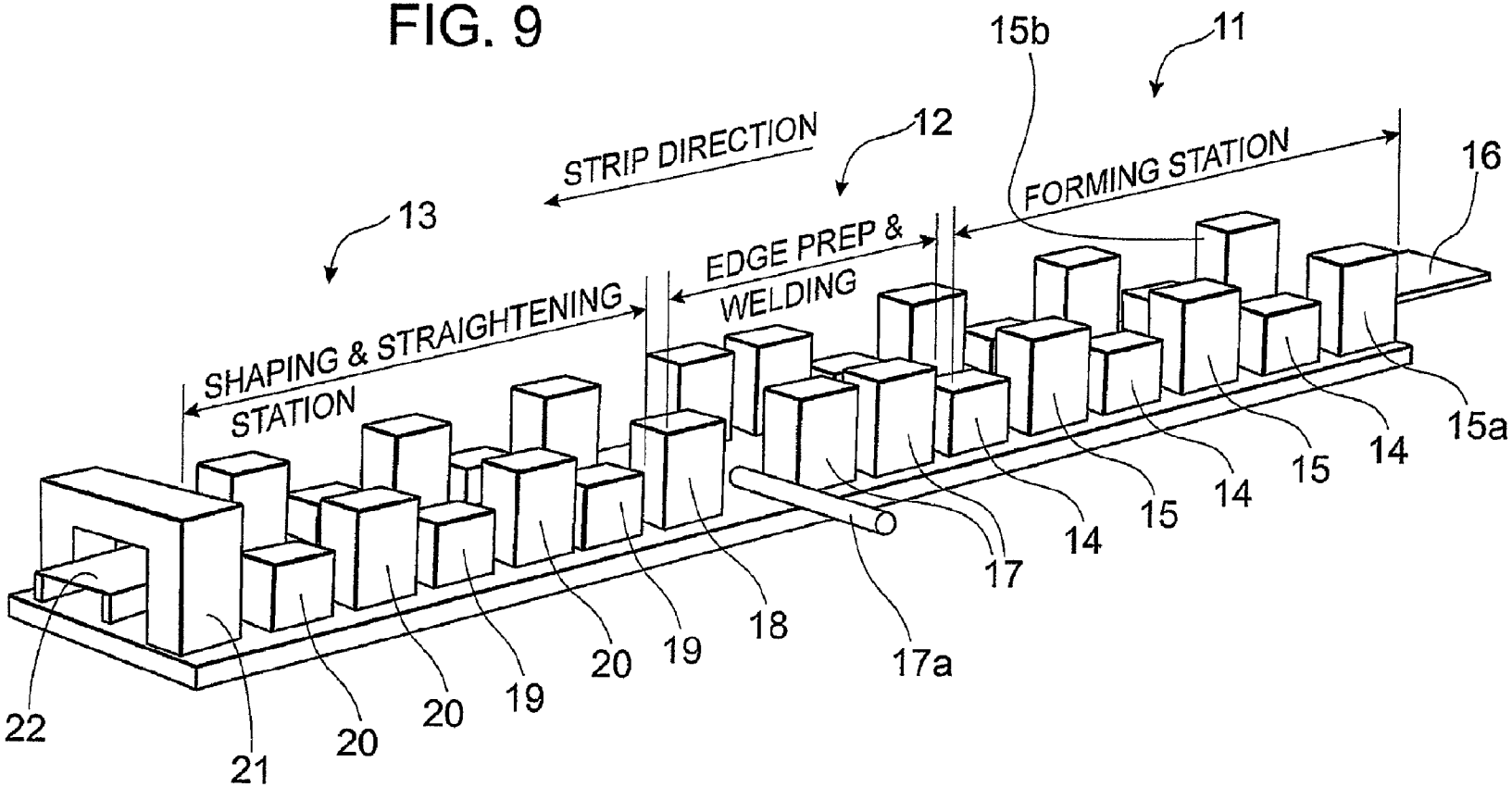
FIG. 9 shows schematically the configuration of a roll forming mill.

FIG. 9 shows schematically a typical configuration of a roll forming mill which may be employed in the manufacture of hollow flange beams according to the invention and as exemplified in FIGS. 5 and 6. Simplistically, the mill comprises a forming station 11, a welding station 12 and a shaping station 13.

Forming station 11 comprises alternative drive stands 14 and forming roll stands 15. Drive stands 14 are coupled to a conventional mill drive train (not shown) but instead of employing contoured forming rolls to assist in the forming process, plain cylindrical rolls are employed to grip steel strip 16 in a central region corresponding to the web portion of the resultant beam. The forming roll stands 15 are formed as separate pairs 15*a*,15*b* each equipped with a set of contoured rollers adapted to form a hollow flange portion on opposite sides of the strip of metal 16 as it passes through the forming station. As the forming roll stands 15*a*,15*b* do not require coupling to a drive train as in conventional cold roll forming mills, forming roll stands 15*a*,15*b* are readily able to be adjusted transversely of the longitudinal axis of the mill to accommodate hollow flange beams of varying width.

When formed to a desired cross-sectional configuration, the formed strip 16 enters the welding station 12 wherein the free edges of respective flanges are guided into contact with the web at a predetermined angle in the presence of a high frequency electrical resistance or inductor welding (ERW) apparatus. To assist in location of the flange edges relative to a desired weld line, the formed strip is directed through seam guide roll stands 17 into the region of the ERW apparatus shown schematically at 17*a*. After the flange edges and the weld seam line on the web are heated to fusion temperature, the strip passes through squeeze roll stands 18 to urge the heated portions together to fuse closed flanges. The welded hollow flange section then proceeds through a succession of drive roll stands 19 and shaping roll stands 20 to form the desired cross-sectional shape of the beam and finally through a conventional turk's head roll stand 21 for final alignment and thence to issue as a dual welded hollow flange beam 22 according to the invention. The high frequency ERW process induces a current into the free edges of the strip and respective adjacent regions of the web due to a proximity effect between a free edge and the nearest portion of the web. Because the thermal energy in the web portion is able to dissipate bi-directionally compared with a free edge of the flange, additional energy is required to induce sufficient heat into the web region to enable fusion with the free edge.

Hitherto it was found that by using conventional roll forming techniques and an ERW process, the quantity of energy required to heat the web portion to fusion temperature is such as to cause the free edge of the flange to become molten and be drawn outside a desired weld seam line. As a result of this strip edge loss, the cross-sectional area of the flange was reduced significantly and control of the strip edge into the weld point became more difficult.

It has now been discovered that the aforementioned difficulties can be overcome by aligning the free edge of the flange with the intended weld line as it is heated and then urging the free edge of the strip into contact with the heated web region along a straight pathway in a direction corresponding to a desired angle of incidence between the web portion and the region of flange edge in the vicinity of the weld seam. This technique also confers an additional advantage in that in the subsequent shaping process, the weld seam is not stressed by shaping as the angle of incidence between the web portion and the region of flange edge adjacent thereto is chosen to correspond with a final cross-sectional web shape. By guiding the free edge of the flange edge along this predetermined trajectory, the "sweeping" effect caused by the rotation of the flange in the squeeze rolls of the welding station avoided the problem of inducing heat into an unnecessarily wide path extending away from the desired weld line as the free edge swept into alignment with the desired weld line.

The far greater control of the high frequency ERW process has led to improved production efficiencies and significantly improved manufacturing tolerances on the dual welded hollow flange beams of the invention.

Figure 10:
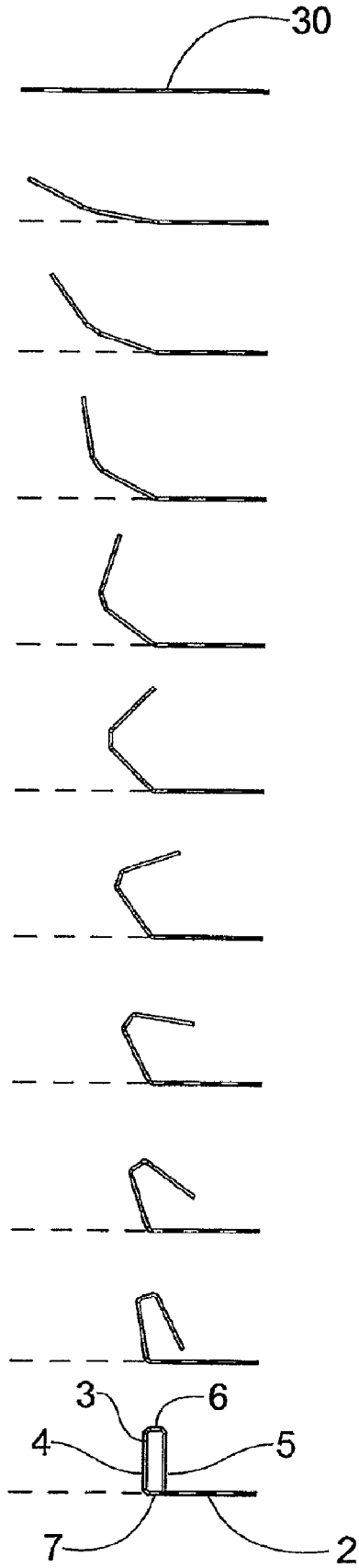
FIG. 10 shows schematically a flower sequence for direct forming a beam according to one aspect of the invention.

FIGS. 10 and 11 show typical flower shapes for the forming, welding and shaping of hollow flange beams as illustrated in FIGS. 5 and 6 respectively. The flower shape leading to the configuration shown in FIG. 6 is preferred in practice as there is less of a tendency to accumulate mill coolant fluid in the channel between the hollow flange sections in the region of the welding station. Moreover, in the FIG. 6 configuration, visibility of the weld to the mill operator is improved. The problems posed by accumulation of mill coolant in the region of the flange seam welds may be overcome by providing suction nozzles and/or mechanical or air curtain wiper blades to keep the weld seams clear of coolant in the induction region of the welding station.

Another alternative is to invert the section profile and form the weld seam under the web outer surface.

A still further alternative is to operate the rolling mill with the beam web oriented in a vertical or upright position.

FIG. 10 shows schematically the development of a hollow flange in a cold roll forming operation by what is known as a direct forming process through an entry point where the flat steel strip 30 enters the mill and a final stage 10 at which edge welding occurs. While not impossible to weld in a continuous cold roll forming process, maintenance of weld stability and section shape is very difficult. Direct formed hollow flange beams of this type may be welded by a consumable electrode process either during the roll forming process or subsequently utilizing automated or semi-automated processes and/or low cost labour. With consumable electrode welding processes, a post welding straightening process is likely to be required to remove warping and local deformations due to the greater heat input. Whether an automated, semi-automated or manual welding process is employed, it is important to employ a continuous weld seam to close the hollow flange formations in order to maintain the greatest structural integrity of the beam so formed.

In the embodiment illustrated, welding is effected at the final stage illustrated and the subsequent processing through the shaping section of a mill merely effects a straightening of any warpage or deformations.

Figure 11A:
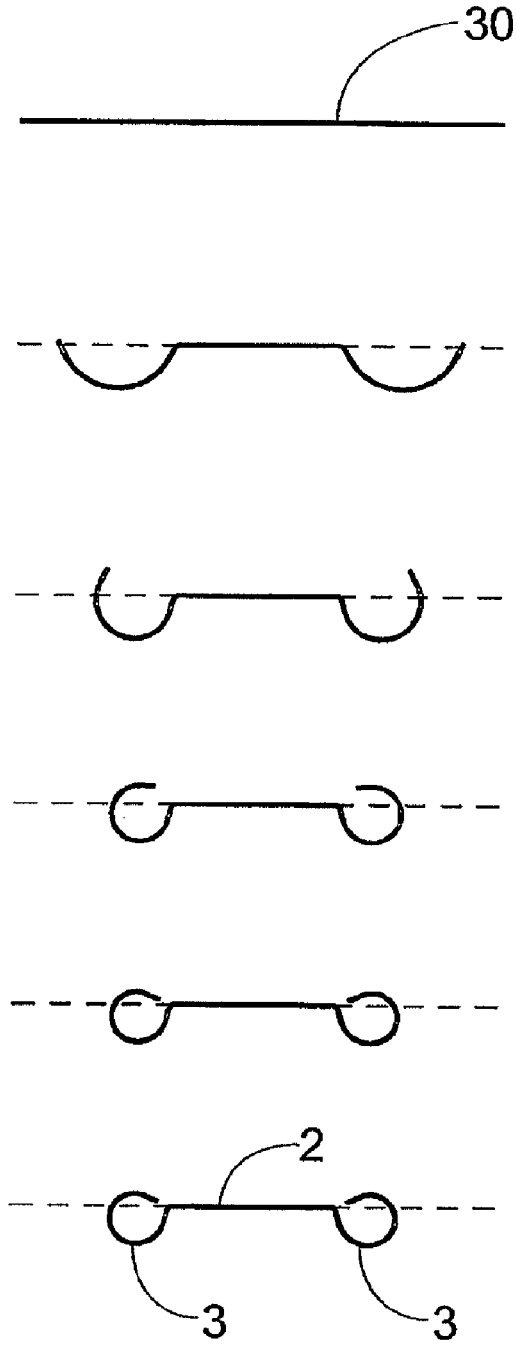
FIG. 11 shows schematically a flower sequence for forming and shaping a beam according to another aspect of the invention.

FIG. 11*a* shows a flower representing the progression of planar steel strip 30 through the forming section of a cold roll forming mill between an entry point through to the edge seam alignment in the welding station just prior to entry into the squeeze rolls of the mill where the free edges of the flanges are brought into contact along the respective side boundaries of web 2.

Figure 11B:
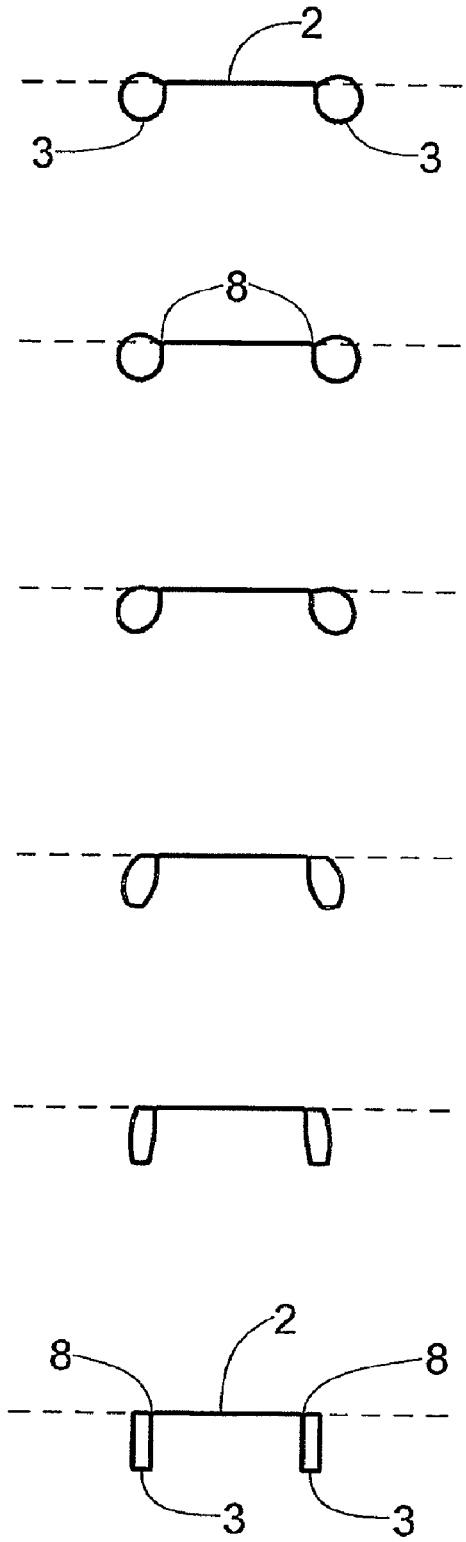

FIG. 11*b* shows a flower progression from the squeeze roll stand in the welding station through the shaping station to the turk's head final straightening. During the shaping of the initially closed flanges 3 as the profile progresses through the shaping station, care is taken to avoid deformation of plastic hinges in the immediate vicinity of the weld seams 8 to avoid imposing stress on the weld seam itself such as to compromise the structural integrity of the beam.

Figure 12:
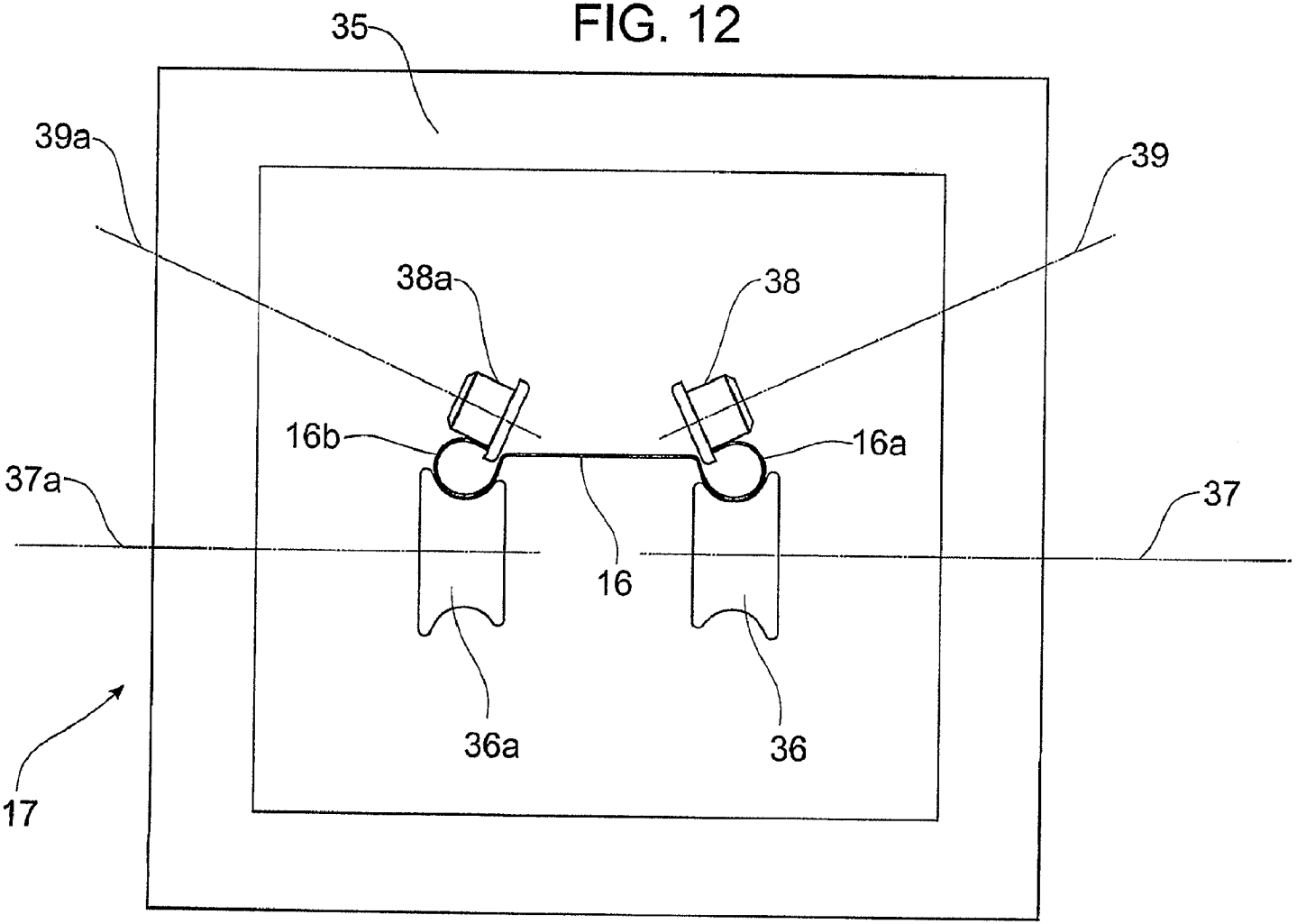
FIG. 12 shows schematically a cross-sectional view through the seam roll region 17 of the welding station 12.

FIG. 12 shows schematically a seam roll stand 17 comprising a support frame 35, a pair of independently mounted, contoured support rolls 36,36*a* each journalled for rotation about aligned rotational axes 37,37*a* and seam guide rolls 38,38*a* rotatably journalled on respective inclined axes 39,39*a*. Seam guide rolls 38,38*a* serve to guide the free edges 16*a*,16*b* of strip 16 into longitudinal alignment with a desired weld seam line as the shaped strip 16 approaches the squeeze roll region of the welding station.

Figure 13:
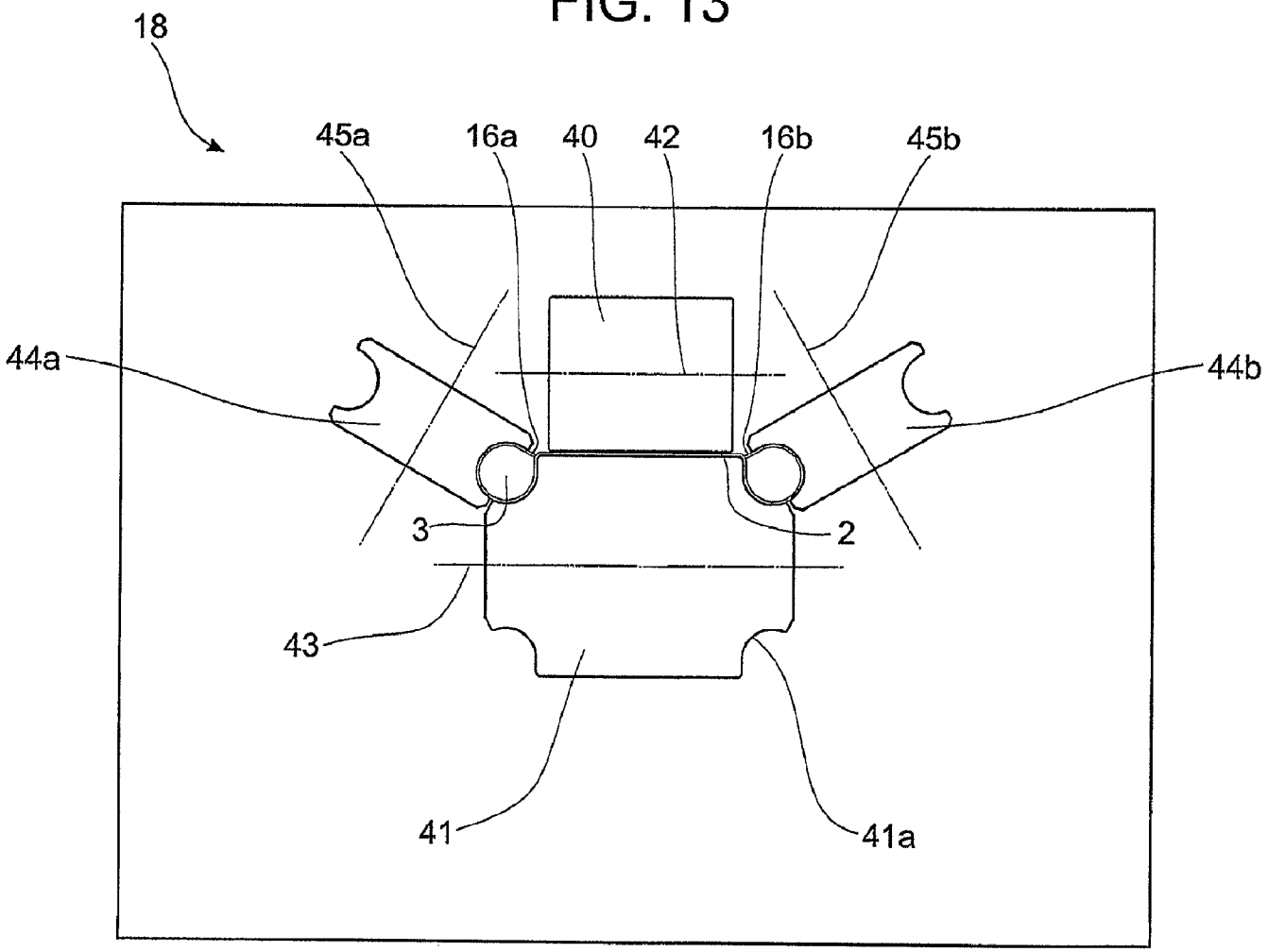
FIG. 13 shows schematically a cross-sectional view though the squeeze roll region 18 welding station 12 at the point of closure of the flanges.

FIG. 13 shows schematically the squeeze roll stand 18 comprising a cylindrical top roll 40 and a cylindrical lower roll 41 with contoured edges 41*a*, each of rolls 40,41 being rotatably journalled about respective rotational axes 42,43. Squeeze rolls 44*a*,44*b*, rotatable about respective inclined axes 45*a*,45*b* are adapted to urge the heated free edges 16*a*, 16*b* of hollow flanges 3 into respective heated weld line regions along the opposed boundaries of web 2 to effect fusion therebetween to create a continuous weld seam.

The free edges 16*a*,16*b* are urged toward respective weld lines in a linear fashion perpendicular to the respective rotational axes 45*a*,45*b* of squeeze rolls 44*a*,44*b* without a transverse "sweeping" action thereby maintaining stable induction "shadows" or pathways on or at the desired position of the weld seams between respective free edges 16*a*,16*b* and the opposed boundaries of web 2.

Figure 13A:
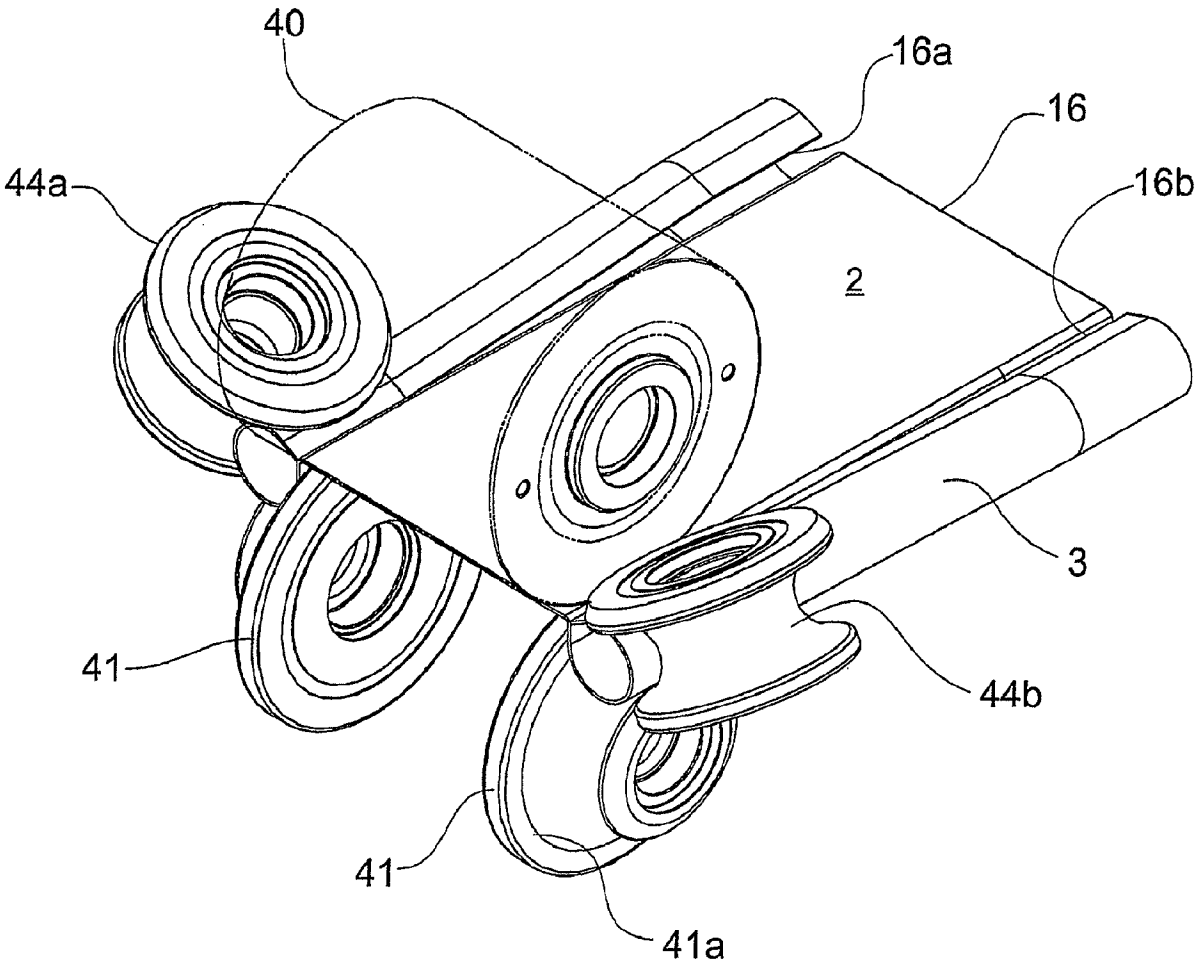

FIG. 13*a* shows schematically in phantom an enlarged perspective view of the relationship of the squeeze rolls 44*a*, 44*b* to upper and lower support rolls 40,41 as the free edges 16*a*,16*b* of strip 16 are guided into fusion with the boundaries of web 2. In the embodiment shown, lower support roll 41 is illustrated as separately journalled roll elements, each with a contoured outer edge 41*a*.

Figure 14:
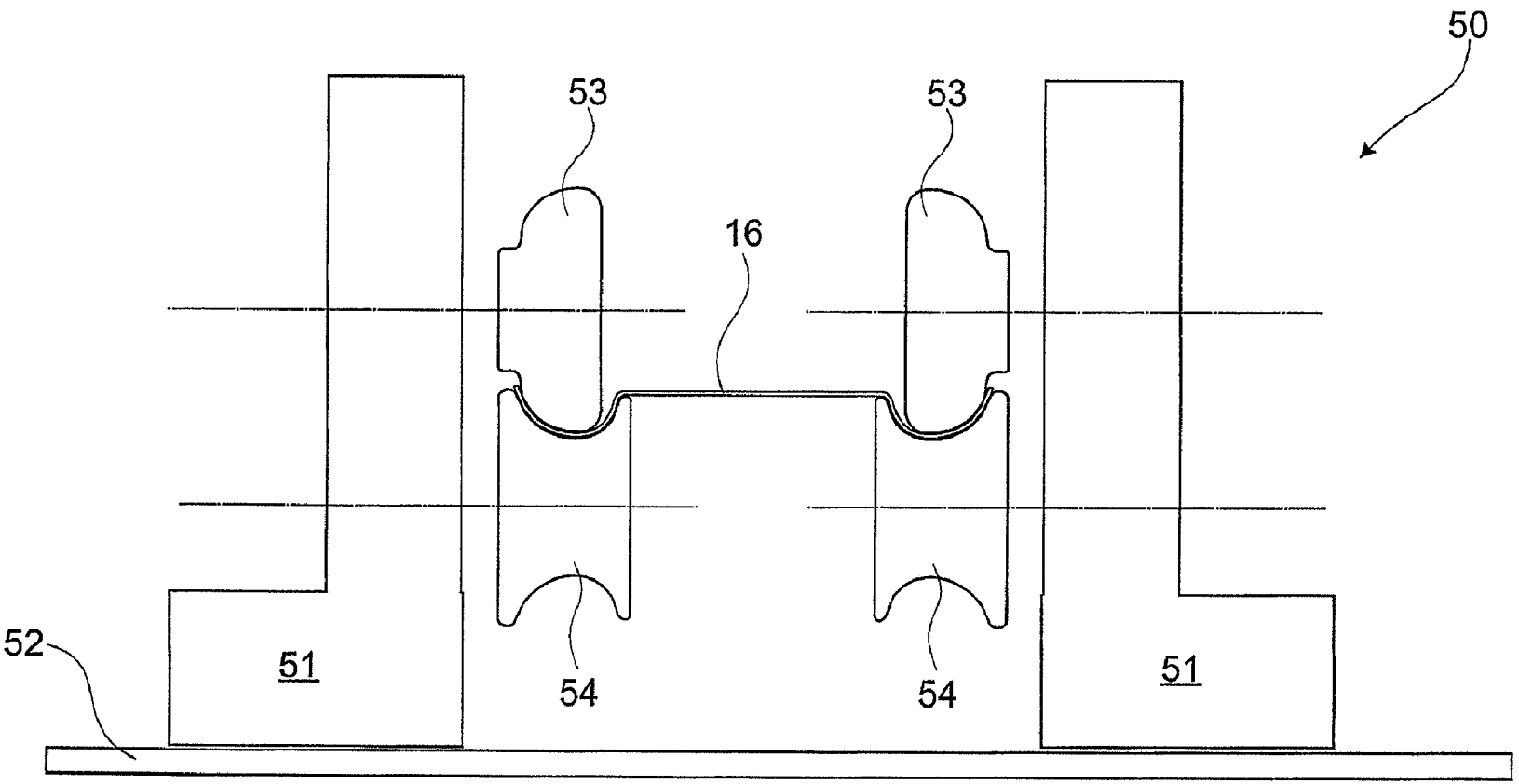
FIG. 14 shows schematically a forming station.

FIG. 14 shows schematically a shaping roll stand 50 comprising independent shaping roll stands 51 slidably mounted on a mill bed 52. Roll stands 51 each support a complementary pair of shaping rolls 53,54 to progressively impart shape to the outer edge regions of steel strip 16 as illustrated generally by the forming flower pattern illustrated in FIG. 11*a*.

As shown, shaping rolls 53,54 are undriven idler rolls.

Figure 15:
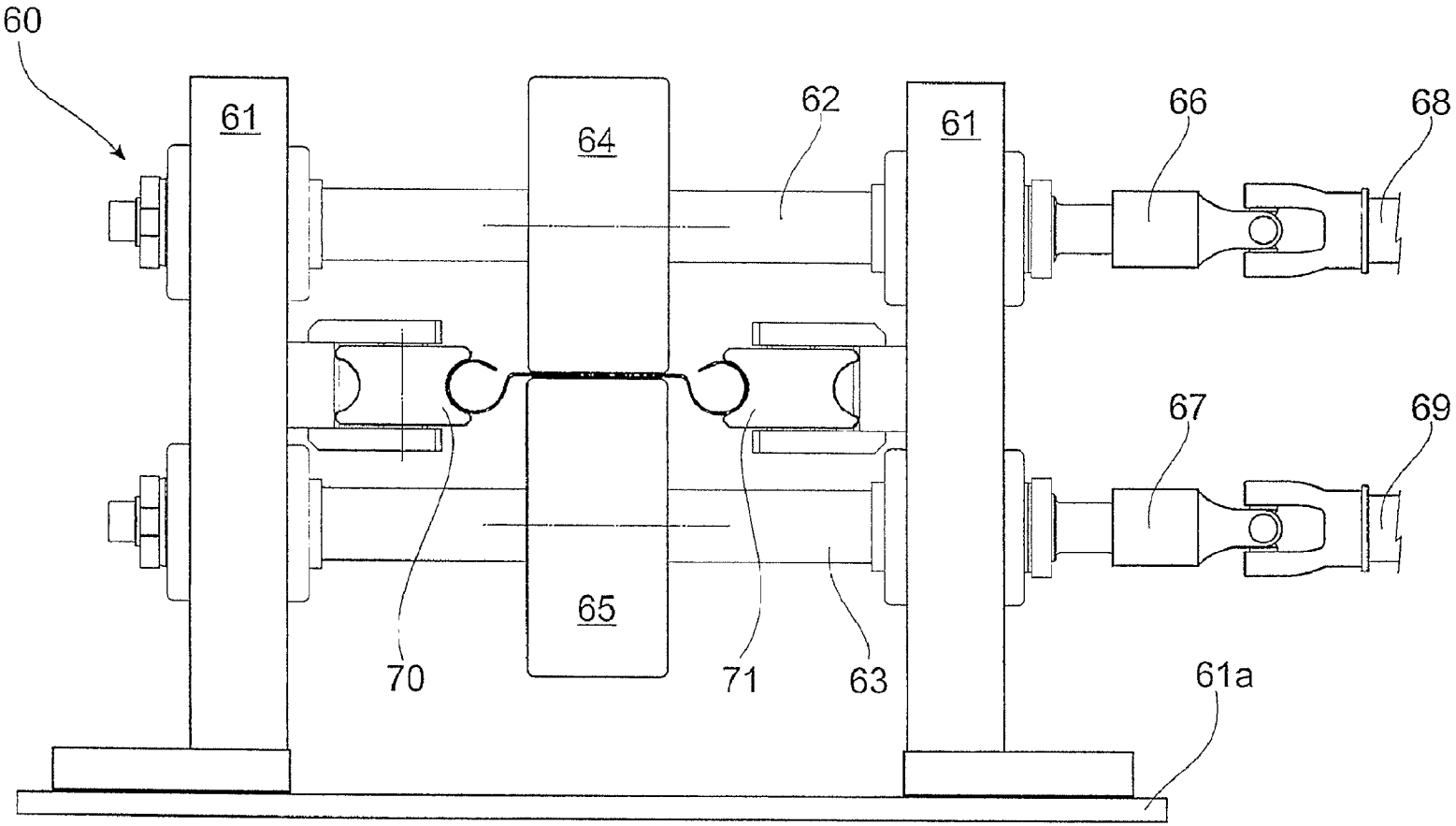
FIG. 15 shows schematically a drive station.

FIG. 15 shows schematically a drive roll stand 60 which may be employed with either of the forming station 11 or shaping station 13 as shown in FIG. 9.

Drive roll stand comprises spaced side frames 61 mounted on a mill bed 61*a*, the side frames 61 rotatably supporting upper and lower driven shafts 62,63 on which are mounted cylindrical drive rolls 64,65 respectively to engage the upper and lower surfaces of the web portion 2 of a hollow flanged member as it is guided through the forming and shaping regions of the cold rolling mill shown generally in FIG. 9. Universal joints 66,67 couple driven shafts 62,63 to output shafts 68,69 of a conventional mill drive train (not shown).

If required, the roll stand 60 may be fitted with strip edge rolls 70,71 to maintain alignment of strip 16 through the mill. The edge rolls may be plain cylindrical rolls or they may be contoured as shown. Rolls 70,71 are adjustably mounted on roll stands 61 to accommodate hollow flange beams of varying widths.

Figure 16:
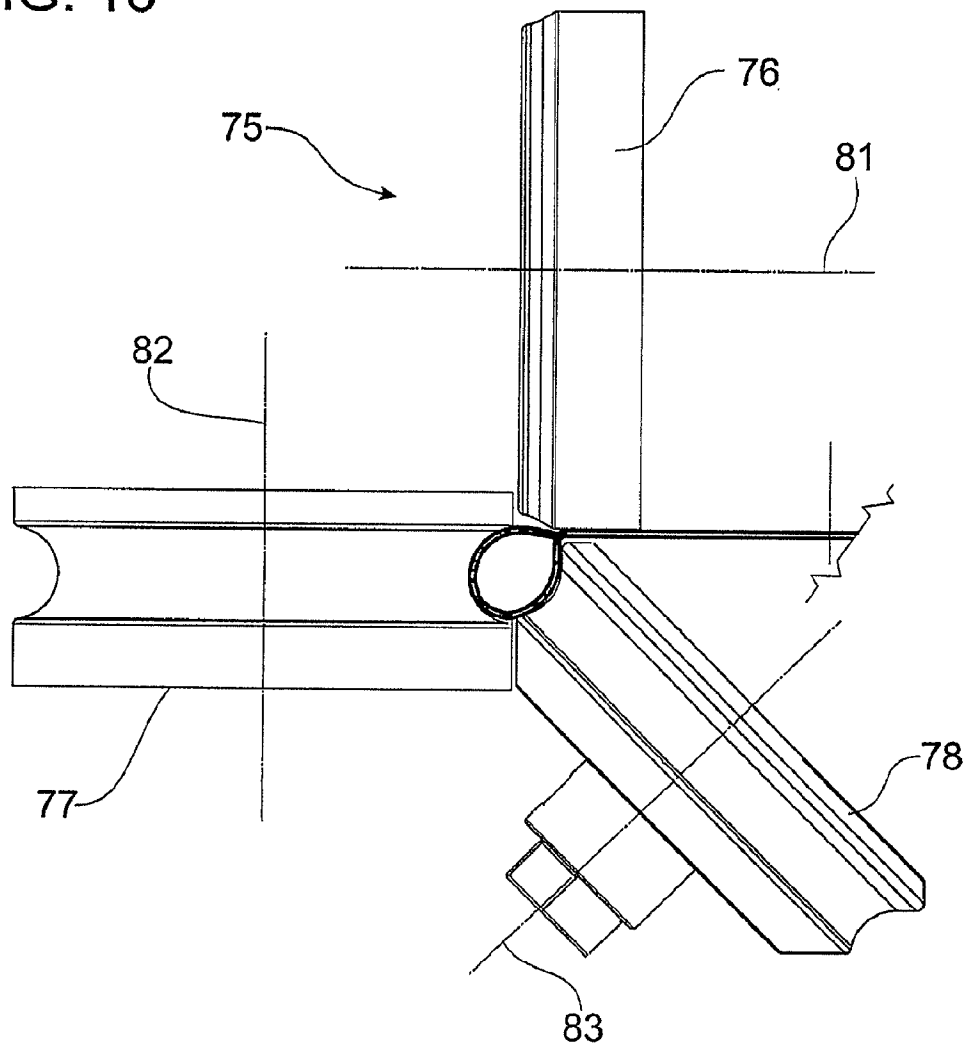
FIG. 16 shows schematically a configuration of shaping rolls in a shaping station.

FIG. 16 shows schematically a configuration of shaping rolls in a shaping mill stand.

Shaping of the flanges 3 is effected by a respective shaping roll set 75 positioned on each side of web 2. As shown, a flange 3 is subjected to shaping pressures from roller 76 mounted for rotation on a horizontal axis 81, roller 77 mounted for rotation on a vertical axis 82 and roller 78 mounted for rotation on an inclined axis 83.

Figure 17:
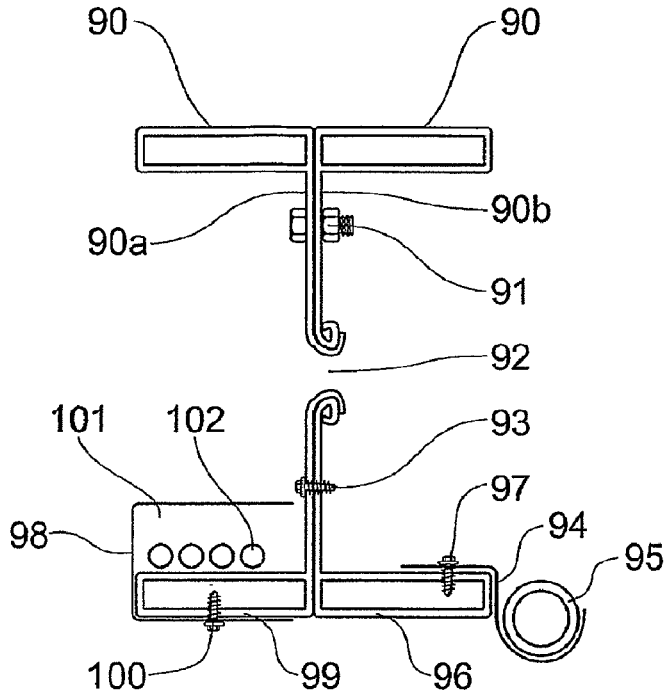
FIGS. 17-21 illustrate the flexibility of beams according to the invention.

FIG. 17 illustrates one application of beams according to the invention.

Where a greater load carrying capacity is required in a location where a beam of greater width cannot be accommodated, a pair of beams 90 can be secured back to back by any suitable fasteners such as a spaced nut and bolt combination 91, a self-piercing clench fastener or the like 92 or a self-drilling self-tapping screw 93 through webs 90*a*. When installed, a support bracket 94 for a utilities conduit 95 may be secured to flange 96 with a screw 97. Similarly, duct for cables may be formed by securing a metal channel section 98 to a flange 99 by a screw 100 or the like to form a hollow cavity 101 to enclose electrical or communications cables 102.

Figure 18:
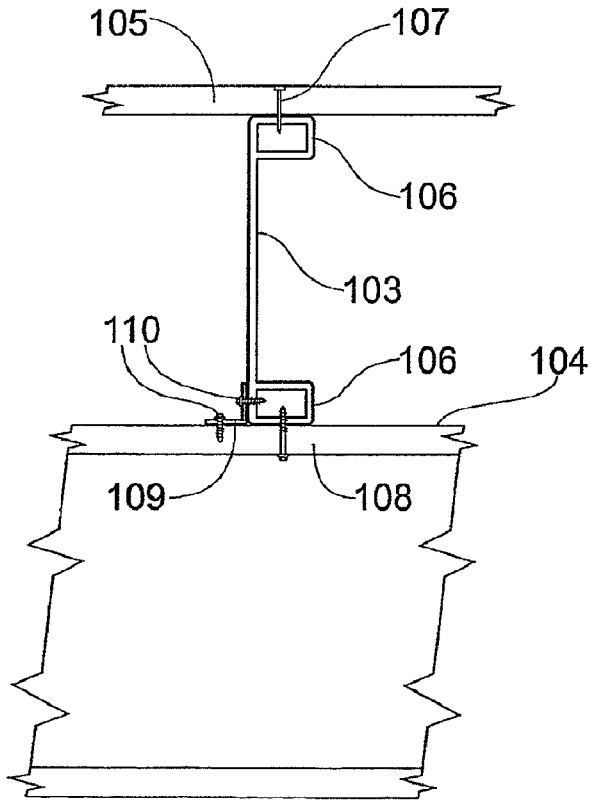

FIG. 18 shows a hollow flange channel 103 functioning as a floor joist. Floor joint 103 is supported on another hollow flange channel 104 functioning as a bearer. Timber flooring 105 is secured to an upper flange 106 by a nail 107 or the like. Similarly, the intersection of respective flanges 106,108 of hollow flange channels is secured by an angle bracket 109 anchored by screws 110 to respective adjacent flanges 106, 108.

Figure 19:
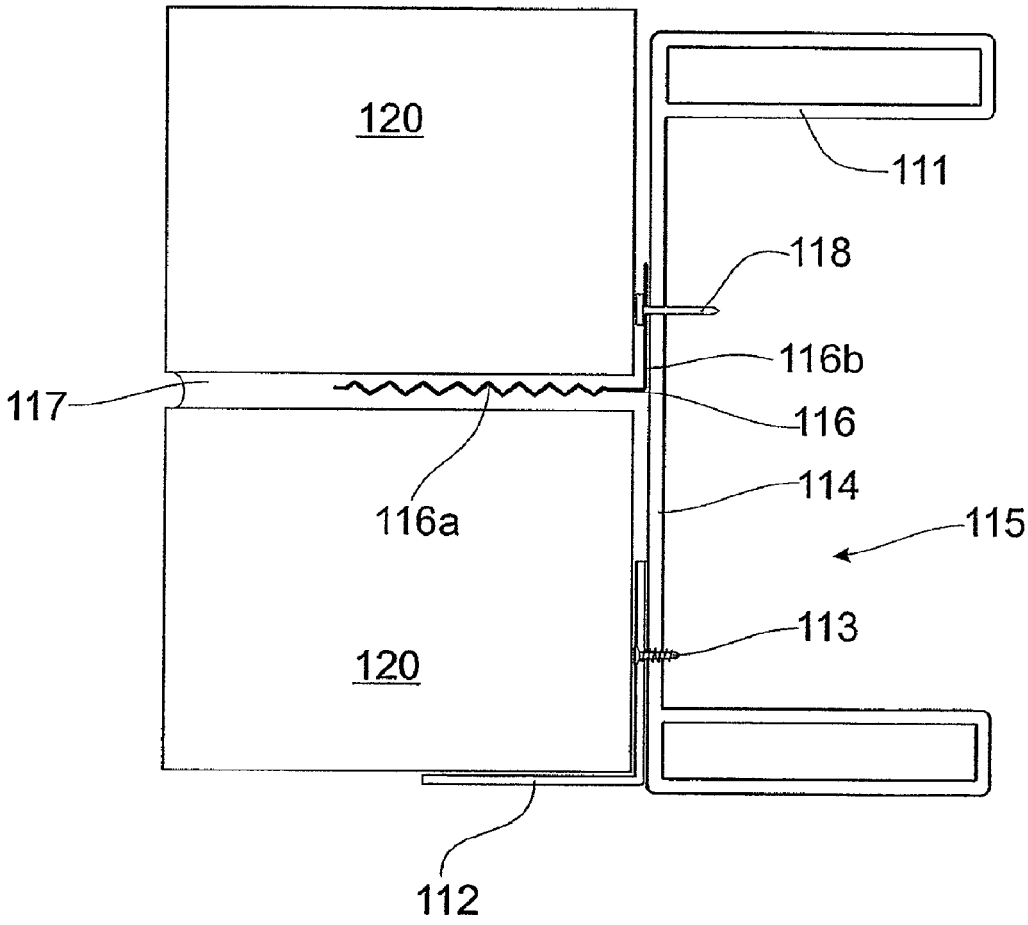

FIG. 19 shows a composite structure 115 in the form of a hollow flange channel 111 and an angle section 112 secured thereto by a screw 113 or the like. Composite structure 115 thus can act as a lintel-like structure to support a door or window opening in a cavity brick structure whereby bricks 120 can rest upon angle section 112 but otherwise be secured to the web 114 of channel 111 by a brick tie 116 having a corrugated portion 116*a* anchored in a mortar layer 117 and a mounting tab 116*b* anchored to web 114 by a screw 118.

Figure 20:
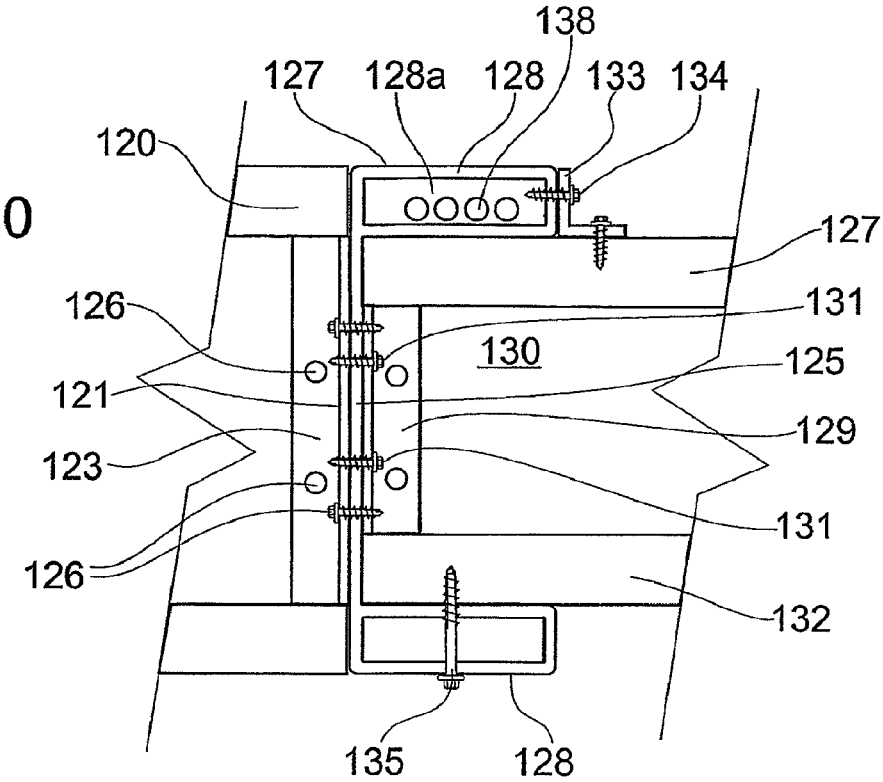

FIG. 20 shows the formation of a cruciform joint between hollow flange channels according to the invention.

In one embodiment, a hollow flange channel 120 may be secured perpendicular to an outer face 121 of a similar sized channel 122 by an angle bracket 123 secured to respective webs 124,125 by rivets, screws or any other suitable fasteners 126.

In another embodiment, a smaller hollow flange channel 127 is nestably located between the flanges 128 of channel 122 and is secured therein by an angle bracket 129 attached to webs 125,130 of channels 122,127 respectively by screws or other suitable fasteners 131.

Alternatively, adjacent flanges 128,132 of channels 122, 127 respectively could be attached by an angle bracket 133 secured by screws 134.

In a still further embodiment, adjacent flanges 128,132 could be secured by a screw-threaded fastener 135 extending between flanges 128 and 132.

If required, the hollow interior 128*a* of the flanges may be employed as ducting for electrical cables 138 or the like.

Figure 21:
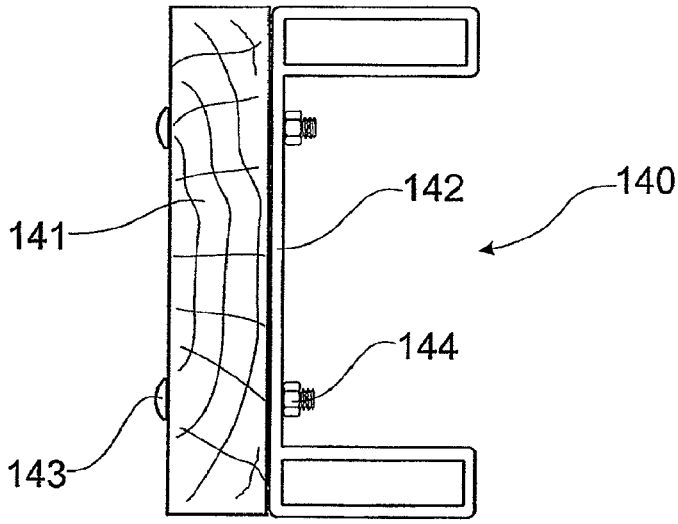

FIG. 21 shows yet another composite beam 140 wherein a timber beam 141 is secured to an outer face of web 142 by mushroom headed bolts 148 and nuts 144 to increase section capacity and/or to provide a decorative finish.

It readily will be apparent to a person skilled in the art that hollow flange channel beams according to the invention not only provide an excellent moment capacity/mass per meter ratio compared with other structural beams, they offer ease of connectivity, ease of handling and flexibility in application which greatly enhances "usability". Taking into account all of the factors which contribute to an in situ installation value or cost, hollow flange channel beams offer significant utility of up to 2.5 times conventional hot rolled beams and laminated timber beams and have moment capacities that permit superior performances over similar sized cold rolled open flange purlins over longer lengths.

Figure 22:
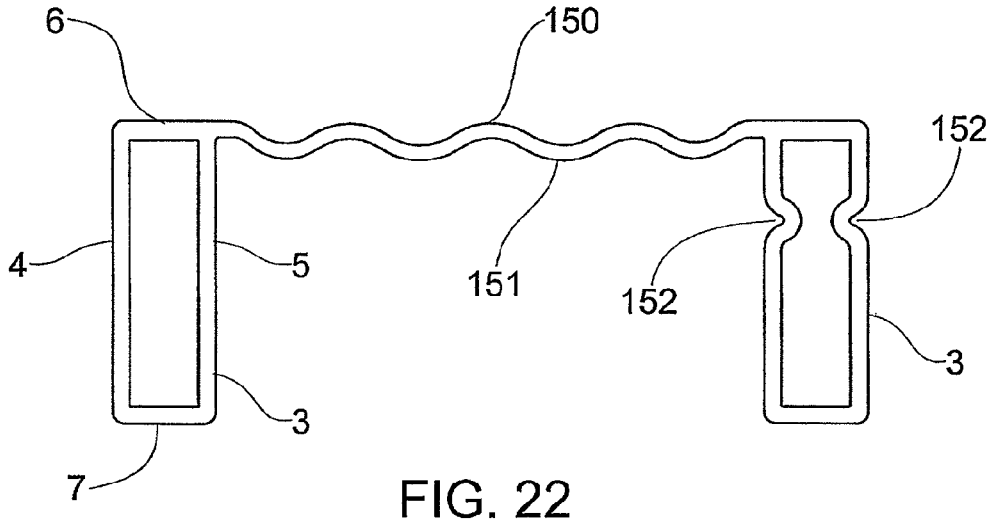
FIG. 22 shows a hollow flanged beam with a reinforced flange and a reinforced web.

FIG. 22 shows an alternative embodiment of the hollow flange beam according to the invention.

As illustrated, the beam is formed with longitudinally extending alternating ribs 150 and troughs 151 to provide greater resistance to longitudinal bending in web 2.

If required, flanges 3 may also have formed therein longitudinally extending stiffening ribs 152.

Figure 23:
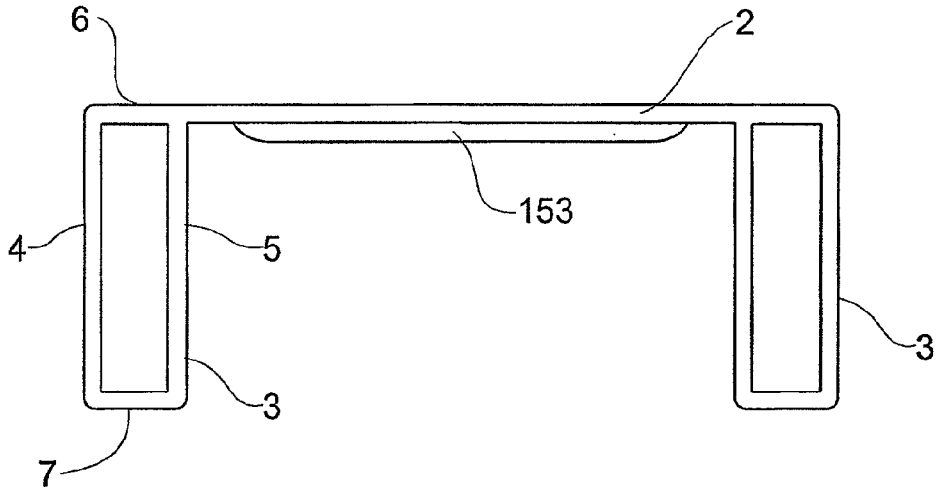
FIG. 23 shows an alternative embodiment of FIG. 22.

FIG. 23 shows yet another embodiment of reinforced web hollow flange beam according to the invention.

In this embodiment, transversely extending spaced ribs 153 provide greater resistance to transverse bending in web 2.

Throughout this specification and claims which follow, unless the context requires otherwise, the word "comprise", and variations such as "comprises" or "comprising", will be understood to imply the inclusion of a stated integer or group of integers or steps but not the exclusion of any other integer or group of integers.

The invention claimed is:

1. A channel-shaped structural beam comprising:

a planar elongate web; and, hollow parallel sided substantially rectangular flanges extending parallel to each other perpendicularly from a plane of said web along opposite sides thereof, said hollow flanges both extending in the same direction away from one face of said web, wherein an end face of each of said flanges is coplanar with said web and continuously welded to one of the opposite sides of said web;

said beam having a ratio of the width of each said flange between opposite end faces thereof in a direction perpendicular to said plane of said web and the depth of said beam between opposite outer faces of said flanges in the ratio of from 0.2 to 0.4, said beam having a ratio of the width of each said flange to the depth of each said flange in the range of from 1.5 to 4.0, and said beam having a ratio of the width of each said flange to the thickness of said web in the range of from 15 to 50.

2. The beam as claimed in claim 1 wherein the ratio of said width of each said flange and the depth of each said flange is in the range of from 2.5 to 3.5.

3. The beam as claimed in claim 2 wherein the ratio of said width of each said flange and said depth of each said flange is in the range of from 2.8 to 3.2.

4. The beam as claimed in claim 1 wherein the ratio of the width of each said flange to the depth of said beam is in the ratio of from 0.25 to 0.35.

5. The beam as claimed in claim 4 wherein the ratio of the width of each said flange to the depth of said beam is in the range of from 0.28 to 0.32.

6. The beam as claimed in claim 1 wherein the ratio of the width of the flange to the thickness of the web is in the range of from 25 to 35.

7. The beam as claimed in claim 6 wherein the ratio of the width of the flange to the thickness of the web is in the range of from 28 to 32.

8. The beam as claimed in claim 1 wherein said beam is fabricated from steel.

9. The beam as claimed in claim 8 wherein said beam is fabricated from high strength steel greater than 300 MPa.

10. The beam as claimed in claim 8 wherein said beam is fabricated from stainless steel.

11. The beam as claimed in claim 1 wherein said beam is fabricated from a single sheet of steel.

12. The beam as claimed in claim 1 wherein said beam is fabricated by a folding process.

13. The beam as claimed in claim 1 wherein said beam is fabricated by a roll forming process.

14. The beam as claimed in claim 1 wherein said structural beam is fabricated in a continuous cold rolling process.

15. The beam as claimed in claim 1 wherein said structural beam is fabricated from sheet steel having a corrosion resistant coating.

* * * * *